US005549440A

United States Patent [19]

Cholakon et al.

[11] Patent Number: 5,549,440

[45] Date of Patent: Aug. 27, 1996

[54] FAST-MAKE COUPLER FOR ATTACHING A WORK IMPLEMENT TO A PRIME MOVER

[75] Inventors: Rifka Cholakon, Stow; Tracy C. Errera, Mogadore; Joseph R. Zeno, Cuyahoga Falls, all of Ohio

[73] Assignee: ACS Industries, Inc., Kent, Ohio

[21] Appl. No.: 365,536

[22] Filed: Dec. 28, 1994

[51] Int. Cl.[6] ..... E02F 3/32

[52] U.S. Cl. ..... 414/723; 37/468

[58] Field of Search ..... 414/723; 37/468; 403/321, 322

[56] References Cited

U.S. PATENT DOCUMENTS

| | | | |
|---|---|---|---|
| 2,691,452 | 10/1954 | Wells, Jr. et al. | 214/131 |
| 3,417,886 | 12/1968 | Stuart | 214/145 |
| 4,295,287 | 10/1981 | Natzke et al. | 37/103 |
| 4,355,945 | 10/1982 | Pilch | 414/686 |
| 4,810,162 | 3/1989 | Foster | 414/723 |
| 4,963,071 | 10/1990 | Larwin et al. | 414/723 |
| 5,082,389 | 1/1992 | Balemi | 403/322 |
| 5,147,173 | 9/1992 | Fauber et al. | 414/723 |
| 5,179,794 | 1/1993 | Ballinger | 403/322 |
| 5,199,844 | 4/1993 | Gilmore, Jr. et al. | 414/694 |
| 5,332,353 | 7/1994 | Arnold | 414/723 |
| 5,382,110 | 1/1995 | Perotto et al. | 403/322 |

*Primary Examiner*—Donald W. Underwood

*Attorney, Agent, or Firm*—Renner, Kenner, Greive, Bobak, Taylor & Weber

[57] ABSTRACT

An improved coupler assembly adapted for connecting a work implement to a prime mover. The main body portion of the coupler assembly has laterally spaced side plates, each of which includes first and second mounting-pin receiving slots having open mouths and apices. The mouths are adapted sequentially to receive first and second mounting pins secured to the work implement. The first slot is longer than the second slot, and the first slot incorporates a locating structure adapted to retain the first mounting pin within the mouths of the first slots before the second mounting pin is capable of being received within the mouths of the second slots. A locking sub-assembly having a rotator member extends laterally between the apices of the first slots. The rotator is mounted for rotation between a first and a second position. The rotator is adapted to engage the first mounting pin, when the rotator is in its first position, to retain the first mounting pin within the apices of the first slots. The rotator is also adapted, when in its second position, selectively to permit the first mounting pin to slide along the first slots after the second mounting pin is in substantial vertical alignment above the second slots.

17 Claims, 14 Drawing Sheets

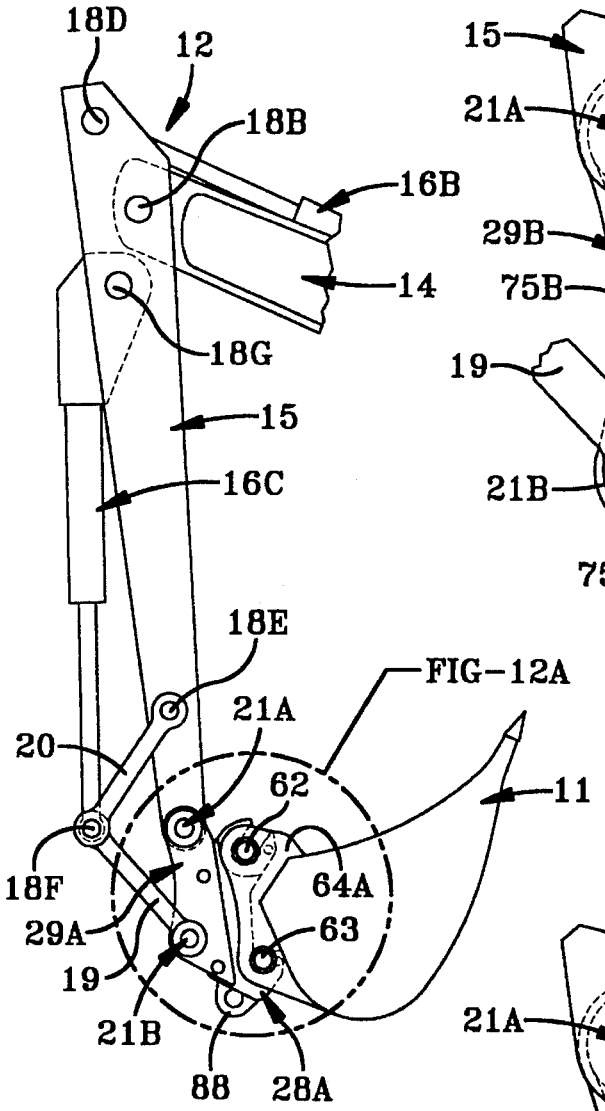
FIG-12
FIG-12A
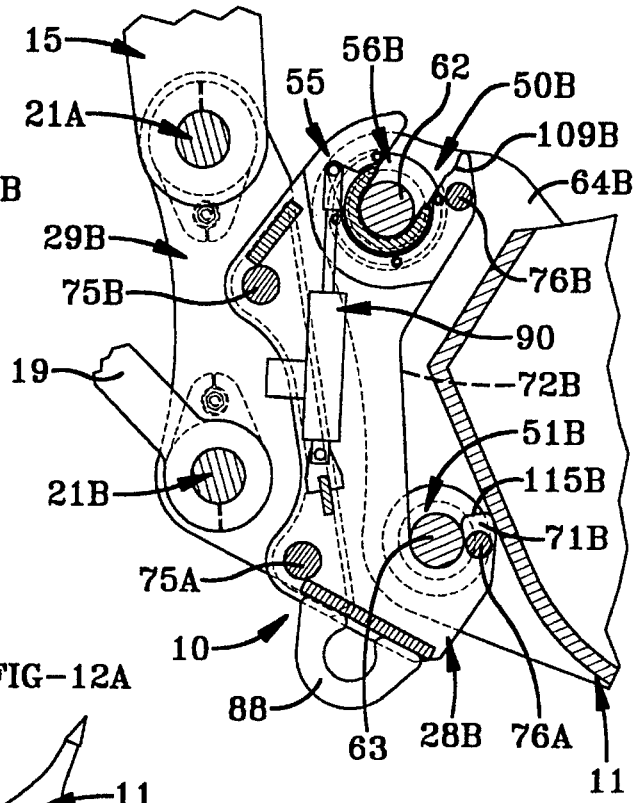
FIG-12B
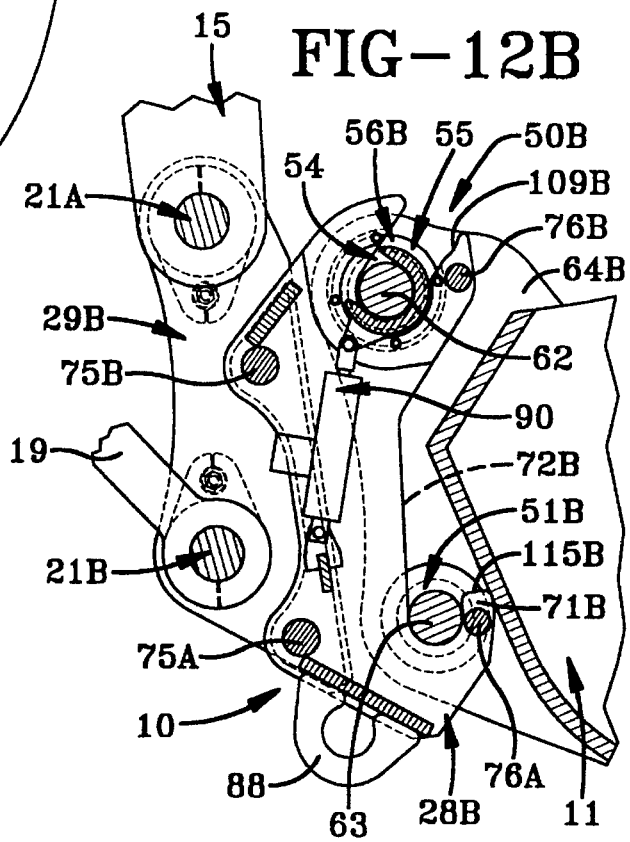

FAST-MAKE COUPLER FOR ATTACHING A WORK IMPLEMENT TO A PRIME MOVER

TECHNICAL FIELD

The present invention relates generally to the structure of coupler assemblies. More particularly, the present invention relates to fast-make coupler assemblies by which to secure a wide variety of work implements, such as those types used for excavation, demolition, compaction and the like to a prime mover. Specifically, the present invention relates to an improved fast-make coupler assembly by which a work implement, aforesaid, can be demountably secured to an articulating boom that is operatively mounted on a prime mover.

BACKGROUND OF THE INVENTION

For many reasons, not the least of which is the relatively high cost for prime movers, it is desirable to be able to employ a single prime mover in conjunction with a plurality of work implements. Historically, it was necessary that individual work implements be laboriously connected to the lifting and tilting mechanisms mounted on prime movers. To change work implements so connected to the prime mover was, at best, a difficult and time-consuming chore that would require two workmen. One of the workmen manipulated the prime mover, as well as the lifting and tilting mechanisms presented therefrom. The second workman manually manipulated the work implement in order to assist in effecting the necessary orientation between the work implement and the boom such that the requisite number of pin connections could be made between the lifting and tilting mechanism and the work implement. The second workman also served as a "spotter" to observe those areas which would be blocked from the view of the workman manipulating the lifting and tilting mechanism presented from the prime mover as well as the prime mover itself. As a spotter, the second workman thus guided the workman operating the prime mover. With two humans involved it was, to some extent, potentially dangerous to life, limb and property every time work implements had to be changed when utilizing the historic arrangements to effect such a change. In addition, there are the purely economic considerations which dictate that the historic means for demountably securing a work implement to a prime mover is a highly inefficient use of workers that is accompanied by extended down-time that translates into high cost.

The normal difficulties attendant upon securing a work implement by historic structural arrangements directly to the lifting and tilting mechanism presented from a prime mover forced efficient operators not only to minimize the number of times that work implements were changed but also to provide a relatively level surface upon which the work implements could be supported inasmuch as the most efficient performance of the inefficient task of manually changing work implements could only occur if both the work implement and the prime mover were on the same level terrain.

Many of the disadvantages that are associated with manually attaching demountable work implements to the lifting and tilting mechanisms on a prime mover were obviated by the system disclosed in U.S. Pat. No. 3,417,886, and as a result that system has received wide acceptance over the years.

But even that arrangement was not perfect, and the difficulties attendant upon the use of that arrangement were obviated by the structure taught in U.S. Pat. No. 4,963,071, which issued on Oct. 16, 1990.

It must be appreciated, however, that the aforesaid prior art was intended primarily for employment with work implements that swung forwardly, and away, from the prime mover during the principal work stroke. Even though the problems encountered when the work implement swings rearwardly, and toward, the prime mover during the principal work stroke are, to some modest extent, related to the problems encountered when the work implement swings forwardly, and away, from the prime mover during the principal work stroke, reversing the direction that the work implement moves during the principal work stroke does engender some rather unique problems for coupler assemblies that are intended for usage in such arrangements.

Previous attempts to provide fast-make coupler assemblies for work implements that swing rearwardly, and toward, the prime mover have involved rather complex locking mechanisms using various mechanical means which are often vulnerable to the rather rugged environmental conditions to which they are exposed.

The most recent attempt to provide a fast-make coupler assembly that is intended to obviate the problems encountered by the prior art is epitomized by the coupler disclosed in U.S. Pat. No. 5,332,353 which issued on Jul. 26, 1994. Even though that arrangement is an improvement over the prior art, it still presents some difficulties in that: it locks to the rear mounting pin on the work implement (where it remains virtually out of the operator's view, even when seated in the normal operator's position in the cab of the prime mover); and, it is secured by a pivotally mounted gate that is itself retained by a manually actuated latch secured by a spring-biased tab to retain the mounting pins presented from the work implement in pin-receiving coupler slots that are oriented at ninety degrees (90°) with respect to each other.

Accordingly, there is a clear need in the art for a fast-make coupler assembly that is not only easily utilized while being reliable and durable in operation but which is also particularly adapted demountably to secure a wide variety of work implements—and particularly work implements that swing rearwardly toward the prime mover during the principal work stroke to the articulating boom of a prime mover, although the most desirable coupler assembly would be equally useful for mounting work implements that swing in either direction during the principal work stroke.

SUMMARY OF THE INVENTION

It is, therefore, a primary object of the present invention to provide a novel, fast-make coupler assembly adapted to facilitate alignment of the mounting bracket on a work implement—such as those used for excavation, demolition, compaction or the like—with the coupler assembly by uncomplicated manipulation of the articulating boom and/or the prime mover from which the coupler assembly is presented.

It is another object of the present invention to provide a fast-make coupler assembly, as above, which utilizes a unique structural arrangement whereby relative uncomplicated, sequential manipulation of the coupler assembly with respect to the work implement can effectively mount a work implement to the coupler assembly, irrespective of the direction in which the work implement moves to perform its principal work stroke.

It is a further object of the present invention to provide a fast-make coupler assembly, as above, which employs a unique, locking sub-assembly that includes a rotator member which not only serves a locking function by which to secure the work implement to the body portion of the coupler assembly but which may, if desired, also be used to assist the operator in orienting the work implement with respect to the coupler assembly, all with a minimum number of parts.

It is still another object of the present invention to provide a fast-make coupler assembly, as above, wherein the rotator member may not only be located to remain visible to the operator from the cab of the prime mover during operation of the work implement so that the locking status of the coupler assembly can be visually monitored, at will, during operation of the work implement but may also be marked, as by a highly visible color, to signal that it is disposed in its locking position.

It is a still further object of the present invention to provide a fast-make coupler assembly, as above, which is both reliable and durable in operation.

It is yet another object of the present invention to provide a fast-make coupler assembly, as above, which is adapted for use with various work implements and prime movers.

It is an even further object of the present invention to provide a fast-make coupler assembly, as above, which is less complex than prior art coupler assemblies and at the same time is more reliable, easy to operate, and does not distribute forces through a locking or latching arrangement to the mechanism by which the coupler is actuated.

These and other objects of the invention, as well as the advantages thereof over existing and prior art forms, which will be apparent in view of the following detailed specification, are accomplished by means hereinafter described and claimed.

In general, an improved coupler assembly embodying the concepts of the present invention is adapted for connecting a work implement—which has laterally oriented, longitudinally spaced, first and second mounting pins—to a prime mover. The prime mover presents an articulating boom and at least one articulating arm, and the coupler assembly has a body portion that is defined by laterally spaced side walls. Customary means are provided to secure the body portion to both the articulating boom and the articulating arm presented from the prime mover.

First and second mounting-pin receiving slots are provided in each of the side plates, and each of the mounting-pin receiving slots has an open mouth portion at one end thereof and an apex portion at the other end thereof. The mouth portions of the first and second mounting-pin receiving slots are adapted sequentially to receive the respective first and second mounting pins. The first mounting-pin receiving slot is preferably longer than the second mounting-pin receiving slot such that the first mounting pin may be retained within the mouth portion of the first mounting-pin receiving slot before the second mounting pin is received within the mouth portion of the second mounting-pin receiving slot.

A rotator means that is included in a locking sub-assembly extends laterally between the apex portions of the first mounting-pin receiving slots in the laterally spaced side walls, and the rotator means is mounted for rotation between at least a first and a second position.

The rotator means is adapted to engage the first mounting pin, when the rotator means is in its first position, to retain the first mounting pin within the first mounting-pin receiving slots.

The rotator means is adapted, when in its second position, to permit the first mounting pin to slide along the first mounting-pin receiving slot in each of the side plates. During normal operations, however, the operator does not manipulate the coupler assembly to permit the first mounting pin to slide along the first mounting-pin receiving slot until after the second mounting pin is in alignment to be received within the second mounting-pin receiving slots. Accordingly, when the first mounting pin is fully received within the first mounting-pin receiving slots, the second pin will also be received within the second mounting-pin receiving slots.

Means are also provided selectively to move the rotator means between its first and second positions.

The rotator means may, if necessary, also be adapted to engage the first mounting pin when the rotator means is in its first position in order to permit the first mounting pin to be retained thereagainst by gravity while the second mounting pin is being aligned with the second mounting-pin receiving slots. This approach would not be required by a skilled operator when mounting a conventional work implement, but a novice operator might appreciate the option. In addition, even a skilled operator might welcome the option when mounting a work implement having a configuration that is sufficiently unique that the first mounting pin tends to slide along the first mounting-pin receiving slots before the second mounting pin can be aligned with the second mounting-pin receiving slots.

To acquaint persons skilled in the arts most closely related to the present invention, one preferred embodiment of an improved coupler assembly that illustrates a best mode now contemplated for putting the invention into practice is described herein by, and with reference to, the annexed drawings that form a part of the specification. The exemplary coupler assembly is described in detail without attempting to show all of the various forms and modifications in which the invention might be embodied. As such, the embodiment shown and described herein is illustrative, and as will become apparent to those skilled in these arts, can be modified in numerous ways within the scope and spirit of the invention—the invention being measured by the appended claims and not by the details of the specification.

BRIEF DESCRIPTION OF THE DRAWINGS

FIG. 12 is a view similar to FIGS. 10 and 11, but showing the third step in the coupling sequence;

FIG. 12A is an enlarged, sagittal cross-section that extends substantially within that portion of FIG. 12 delineated by the chain-line circle that is designated as FIG. 12A on FIG. 12—the rotator member being disposed in what is designated as its second position; and, FIG. 12B is a view similar to FIG. 12A, but depicting the rotator member in its first position to lock a mounting pin therein.

DESCRIPTION OF AN EXEMPLARY EMBODIMENT

Figure 1:
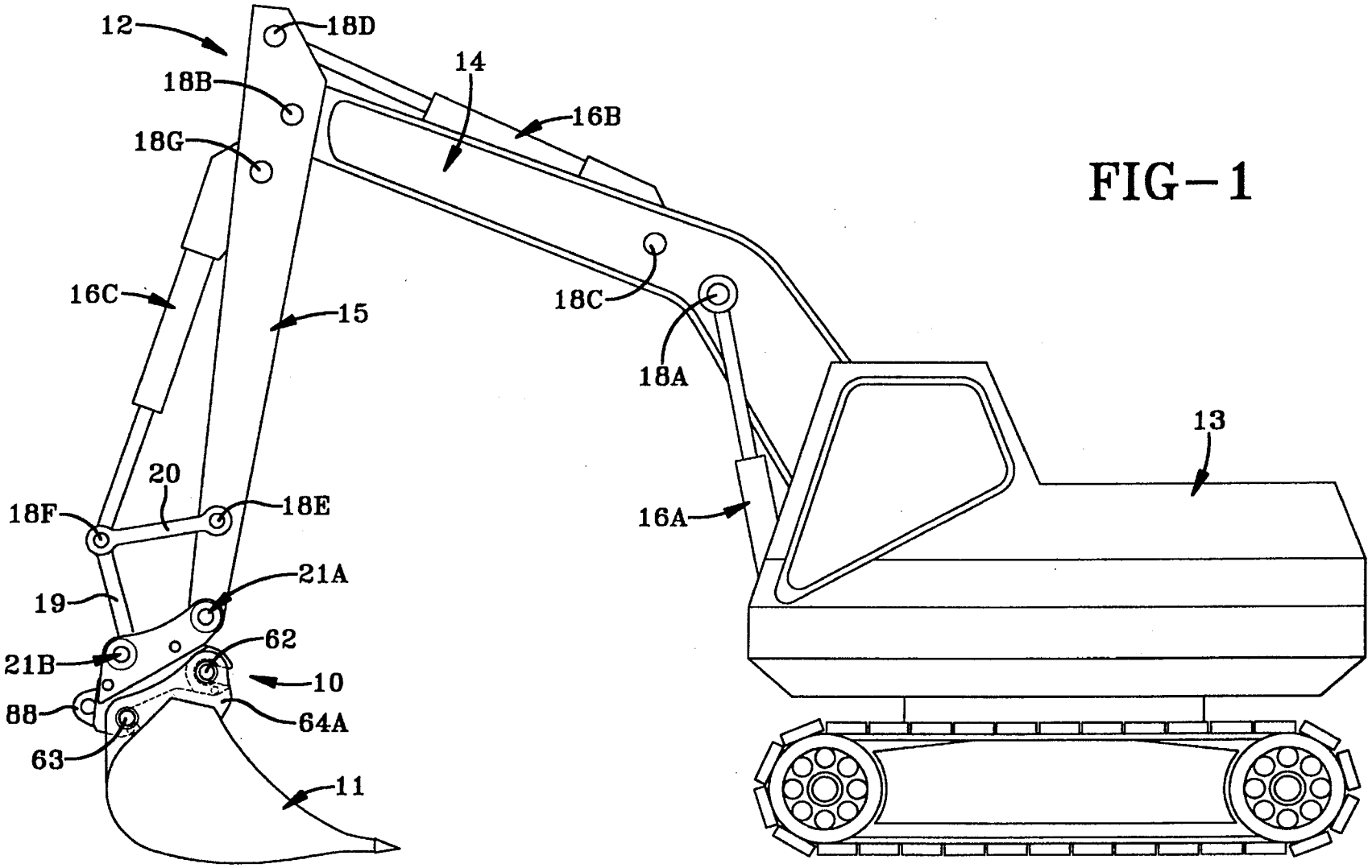
FIG. 1 is a side elevational view of a prime mover having an articulating boom to which a work implement in the nature of a backhoe is attached by a fast-make coupler assembly incorporating the concepts of the present invention.
Figure 2:
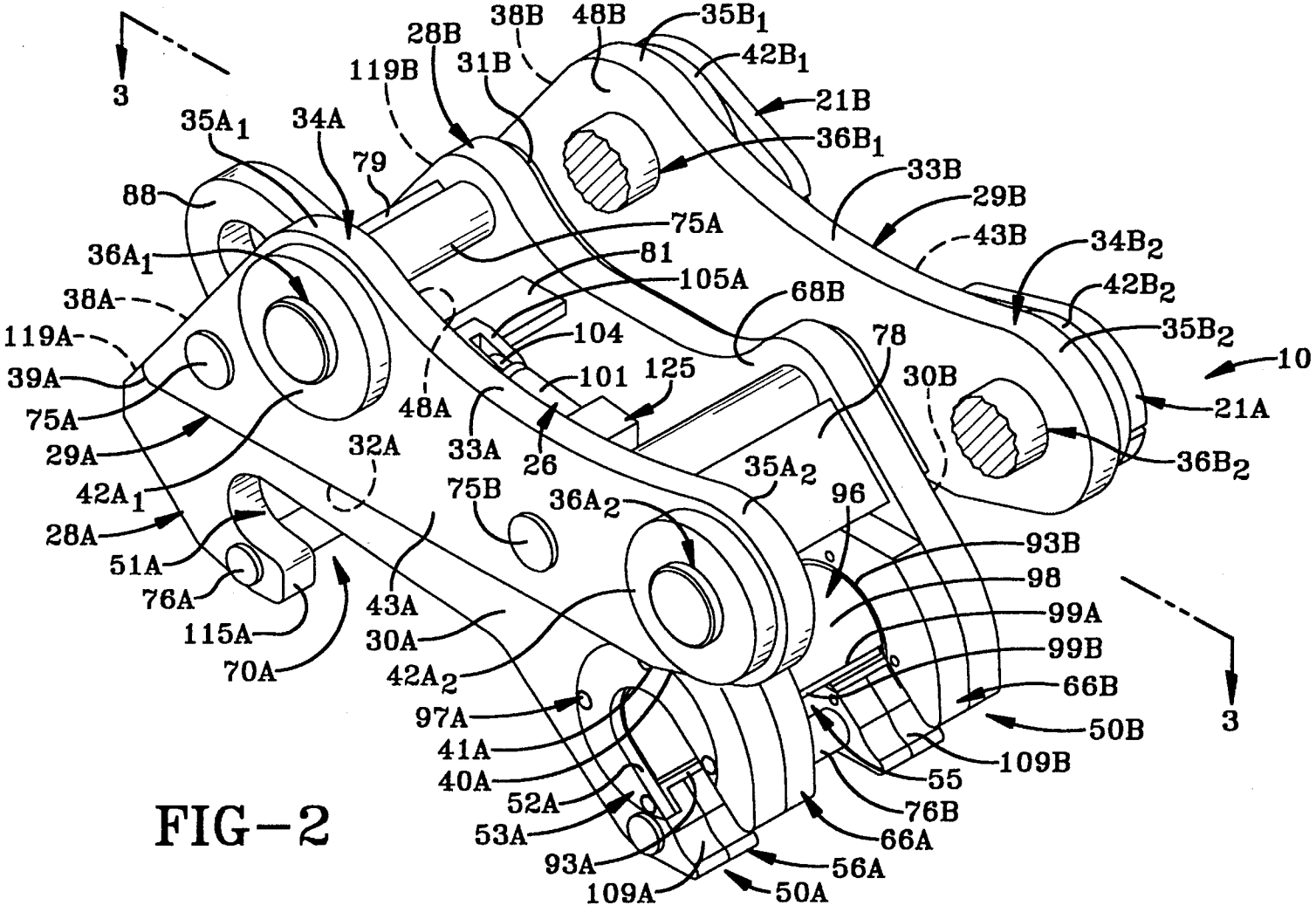
FIG. 2 is an enlarged perspective view of the coupler assembly depicted in FIG. 1.
Figure 3:
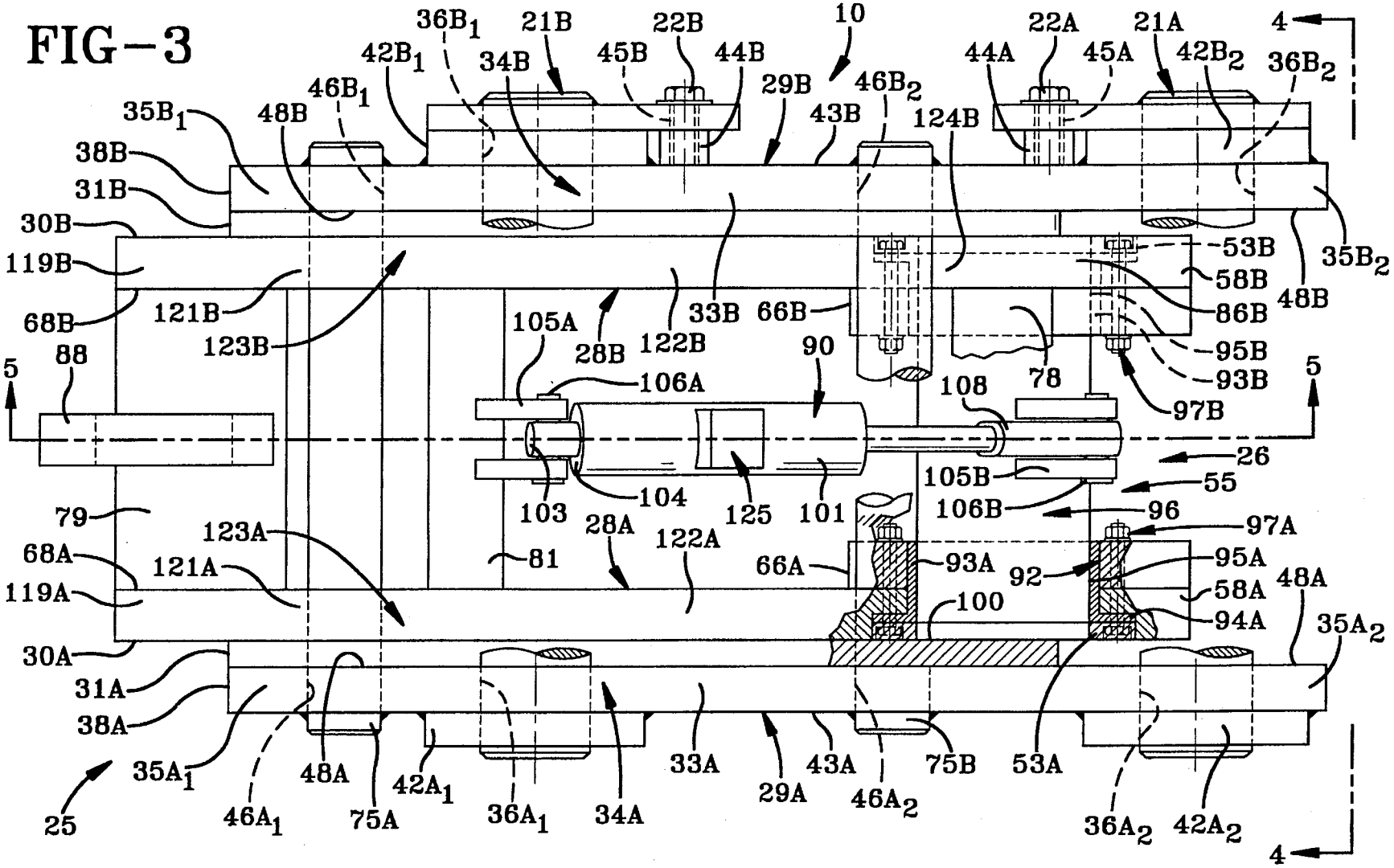
FIG. 3 is a further enlarged top plan view of the coupler assembly, FIG. 3 being taken substantially along line 3—3 of FIG. 2.
Figure 4:
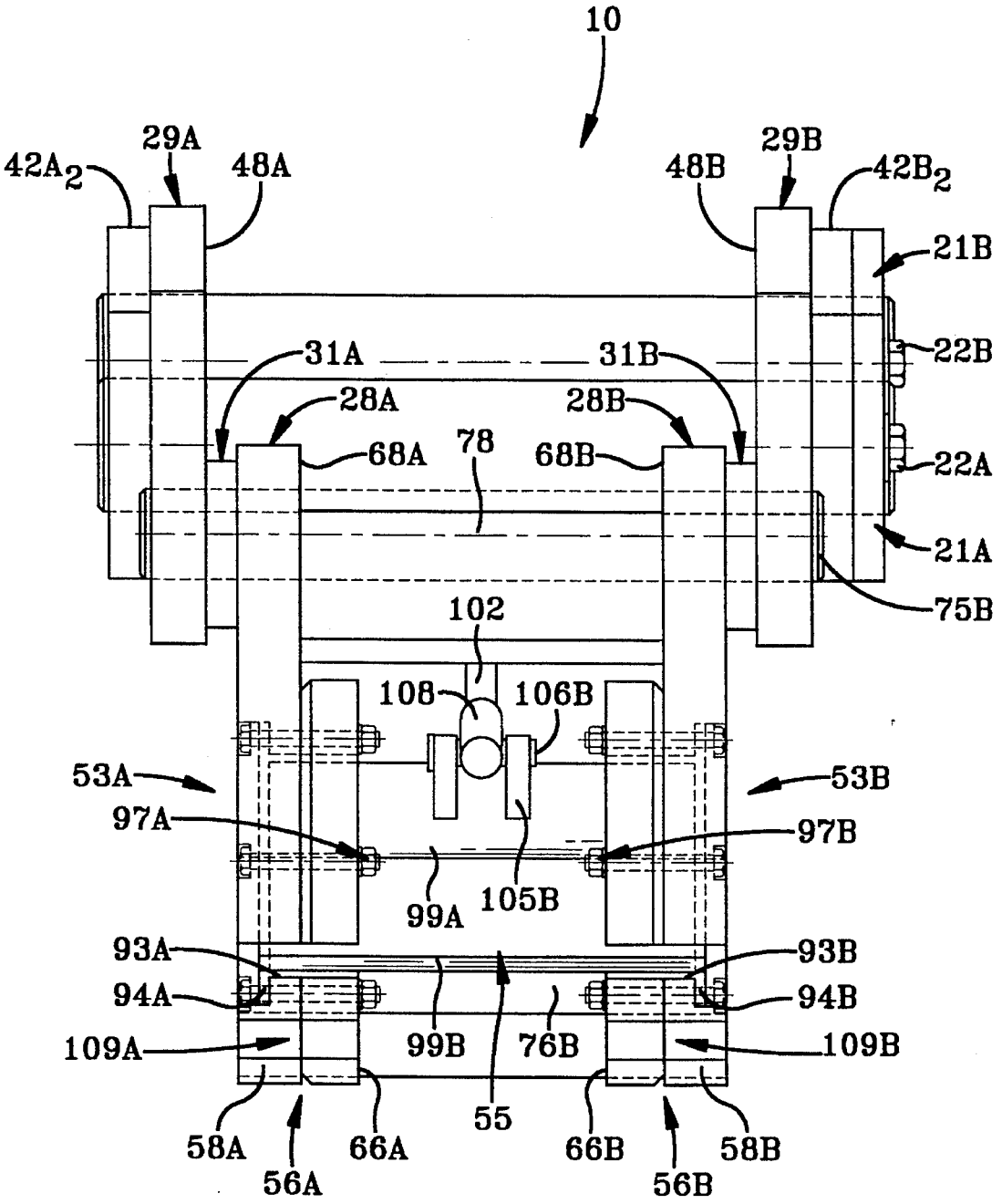
FIG. 4 is an end elevational view of the coupler assembly, FIG. 4 being taken substantially along line 4—4 of FIG. 3.

An improved, fast-make coupler assembly embodying the concepts of the present invention is designated generally by the numeral 10 on the accompanying drawings. As is depicted in FIG. 1, the fast-make coupler assembly 10 (hereinafter simply "the coupler assembly 10") is utilized demountably to secure a work implement, such as the backhoe bucket depicted, 11 to an articulating boom 12 that is operatively mounted on a prime mover 13.

As shown, the articulating boom 12 may include proximal and distal boom arms 14 and 15, respectively. The inboard end (not shown) of the proximal boom arm 14 is pivotally supported from the prime mover 13 in a manner well known to the art. The proximal boom arm may be raised and lowered about the inboard end thereof by a piston/cylinder arrangement 16A that is pivotally connected between the prime mover 13 and a pivot pin 18A that may extend transversely through the proximal boom arm 14. The inboard end portion of the distal boom arm 15 is mounted to the outboard end of the proximal boom arm 14 for articulation about a pivot pin 18B. Articulation of the distal boom arm 15 may be selectively controlled by piston/cylinder arrangement 16B. Specifically, one end of the piston/cylinder arrangement 16B is pivotally supported from the proximal boom arm 14, as by pivot pin 18C, and the other end of the piston/cylinder arrangement 16B is secured to a pivot pin 18D that extends transversely through the lever arm portion of the distal boom arm 15 at the inboard end thereof.

As previewed in the previous paragraph, and as will be continued in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus, there are at least two piston/cylinder arrangements associated with the articulating boom 12. The piston/cylinder arrangements are generally identified by the numeral 16, but the specific, individual, piston/cylinder arrangements are, therefore, identified as 16A, 16B, etc. in the specification and on the drawings. On some occasions a numerical subscript shall be employed after the letter suffix when it is necessary, or desirable, to distinguish (as to location) two items that might otherwise properly be designated by the alphanumeric combination of a common number with the same letter suffice. These suffix conventions shall be employed throughout the specification.

Returning to FIG. 1, it will also be observed that an articulating arm 19 is operatively associated with the distal boom arm 15 to effect pivotal movement of the coupler assembly 10 about the outboard end of the distal boom arm 15. Specifically, the inboard end of a tie rod 20 is pivotally supported on a pivot pin 18E that extends through the distal boom arm 15, and the outboard end of the tie rod 20 is pivotally connected not only to the piston/cylinder arrangement 16C but also to the inboard end of the articulating arm 19, as by pivot pin 18F. The other end of piston/cylinder arrangement 16C is anchored to the inboard end portion of the distal boom arm 15, as by pivot pin 18G. As such, the piston/cylinder arrangement 16C, in combination with the tie rod 20, effects selective, pivotal movement of the coupler assembly 10 by relative movement of the articulating arm 19 with respect to the distal boom arm 15.

The novel coupler assembly 10 is not only secured to the outboard end of the distal boom arm 15—as by a well-known, pivot-pin locking sub-assembly 21A—but also to the outboard end of the articulating arm 19—as by an identical, pivot-pin locking sub-assembly 21B. Each of the standard, pivot-pin locking sub-assemblies 21A and 21B may include a locking cap screw 22A and 22B (FIGS. 3 through 6). Thus, the coupler assembly 10—which is secured to the articulating boom 12—provides an operative connection for demountably attaching the work implement 11 thereto, and the articulating boom 12 is, in turn, operatively mounted on the prime mover 13.

The structural details of the coupler assembly 10 can best be seen by reference to FIGS. 2 through 6. With particular reference to those figures, the coupler assembly 10 has a main body portion 25 within which a locking sub-assembly 26 is mounted. The main body portion 25 includes a pair of laterally spaced side members, or plates, 28A and 28B, and a pair of laterally spaced mounting members, which may also be plates, 29A and 29B secured to the outwardly directed faces 30A and 30B of the respective side plates 28A and 28B. The mounting plates 29 extend upwardly from the side plates 28, as viewed in FIGS. 2 and 5.

To keep the lateral dimension of the main body portion 25 as compact as reasonably possible—which serves to maintain strength and stability without unduly increasing the weight—and also to assure that the side plates 28A and 28B will properly engage the work implement 11, as is hereinafter more fully explained, it may be necessary to interpose shim plates 31A and 31B between each side plate 28A and 28B and the adjacent mounting plate 29A and 29B, respectively, in order to assure that the laterally spaced mounting plates 29 will receive the outboard end of the distal boom arm 15 therebetween. Accordingly, the usage of shim plates 31 is a purely optional means by which to accommodate any required spacing differences between the side plates 28 and the mounting plates 29. Considerable strength can also be imparted to the coupler assembly 10 by having the side plates 28 as well as the mounting plates 29 fabricated, for example, from appropriate steel plate approximately 1¼ inches thick, or larger, if necessary.

As depicted, the mounting plates 29 may each present a generally planar lower edge 32 to provide maximum support to the adjacent side plates 28. However, the central portion 33 of the upper edge 34 may be curvilinear, such as the arcuate portion depicted, to provide operational clearance for the work implement and/or to reduce weight. With specific reference to mounting plate 29A, one end (arbitrarily designated as the rear) of the curvilinear central portion 33A merges into a circumferential edge portion $35A_1$ that extends concentrically about a pin-receiving aperture $36A_1$. The other end (arbitrarily designated as the front) of the curvilinear central portion 33A merges into a circumferential edge portion $35A_2$ that extends concentrically about a pin-receiving aperture $36A_2$. The circumferential portion $35A_1$ merges into a slanted rear edge 38A that joins the planar, lower edge 32A to form an acute angle of approximately forty-five degrees (45°) at the rear apex 39A of the mounting plate 29A. The circumferential portion $35A_2$ merges into a slanted front edge 40A that joins the planar, lower edge 32A to form an obtuse angle of approximately one hundred and sixty degrees (160°) at the frontal junction 41A of the mounting plate 29A. The two, cylindrical, pin-receiving apertures $36A_1$ and $36A_2$ in the mounting plate 29A may be surrounded by individual boss plates $42A_1$ and $42A_2$, each of which may, as shown, be secured, as by welding, to the outwardly directed face 43A of the mounting plate 29A. However, the boss plates 42A may, if desired and if permitted by the size of the outboard end of the distal boom arm 15, be secured to the inwardly directed face 48A of the mounting plate 29A.

Turning now to mounting plate 29B, the front of the curvilinear central portion 33B merges into a circumferential edge portion $35B_1$, and the circumferential portion $35B_1$ similarly merges into a slanted rear edge 38B that joins the planar, lower edge 32B to form an acute angle of approximately forty-five degrees (45°) at the rear apex 39B of the mounting plate 29B. The circumferential portion $35B_2$ merges into a slanted front edge 40B that joins the planar, lower edge 32B to form an obtuse angle of approximately one hundred and sixty degrees (160°) at the frontal junction 41B of the mounting plate 29B. The two, cylindrical, pin-receiving apertures $36B_1$ and $36B_2$ in the mounting plate 29B may be surrounded by individual boss plates $42B_1$ and $42B_2$, each of which may, as shown, be secured, as by welding, to the outwardly directed face 43B of the mounting plate 29B. However, the boss plates 42B may, if the same criteria appropriate to the location of the boss plates 42A are met, also be secured to the inwardly directed face 48B of the mounting plate 29B.

A pair of locking posts 44A and 44B may extend outwardly from the outwardly directed face 43B on mounting plate 29B in relatively close proximity to the boss plates $42B_1$ and $42B_2$. A threaded bore 45A and 45B would preferably extend axially into each respective locking post 44A and 44B to receive a corresponding locking cap screw 22A and 22B in a manner well known to the art for securing each pivot-pin locking sub-assembly 21A and 21B to the coupler assembly 10. Slightly below and to the arbitrarily designated rear of each pin aperture $36A_1$, $36A_2$, $36B_1$ and $36B_2$ is a corresponding cross-bar aperture $46A_1$, $46A_2$, $46B_1$ and $46B_2$, the purpose of which will be hereinafter more fully explained.

The side plates 28A and 28B are each characterized by the respective first and second mounting-pin receiving slots 50 and 51. As will become hereinafter apparent, the slots 50 serve not only the function of receiving, and partially guiding, the first mounting pin 62 but also the function of receiving the rotator member 55 of the locking sub-assembly 26. Receiving and guiding the first mounting pin 62 is also assisted by the slotted recesses 65A and 65B in the bearing support plates 66A and 66B and accommodated by the slotted recesses 52A and 52B in the rotator retaining plates 53A and 53B.

It should be understood that the rotator retaining plates 53A and 53B are preferably received in the respective recesses 57A and 57B provided in the outwardly directed faces 30A and 30B of the respective side plates 28A and 28B in order to assure that the desired, full lateral contact may be achieved between the hereinafter described attaching plates 64A and 64B on the work implement 11 and the outwardly directed faces 30A and 30B on the side plates 28A and 28B.

Figure 5:
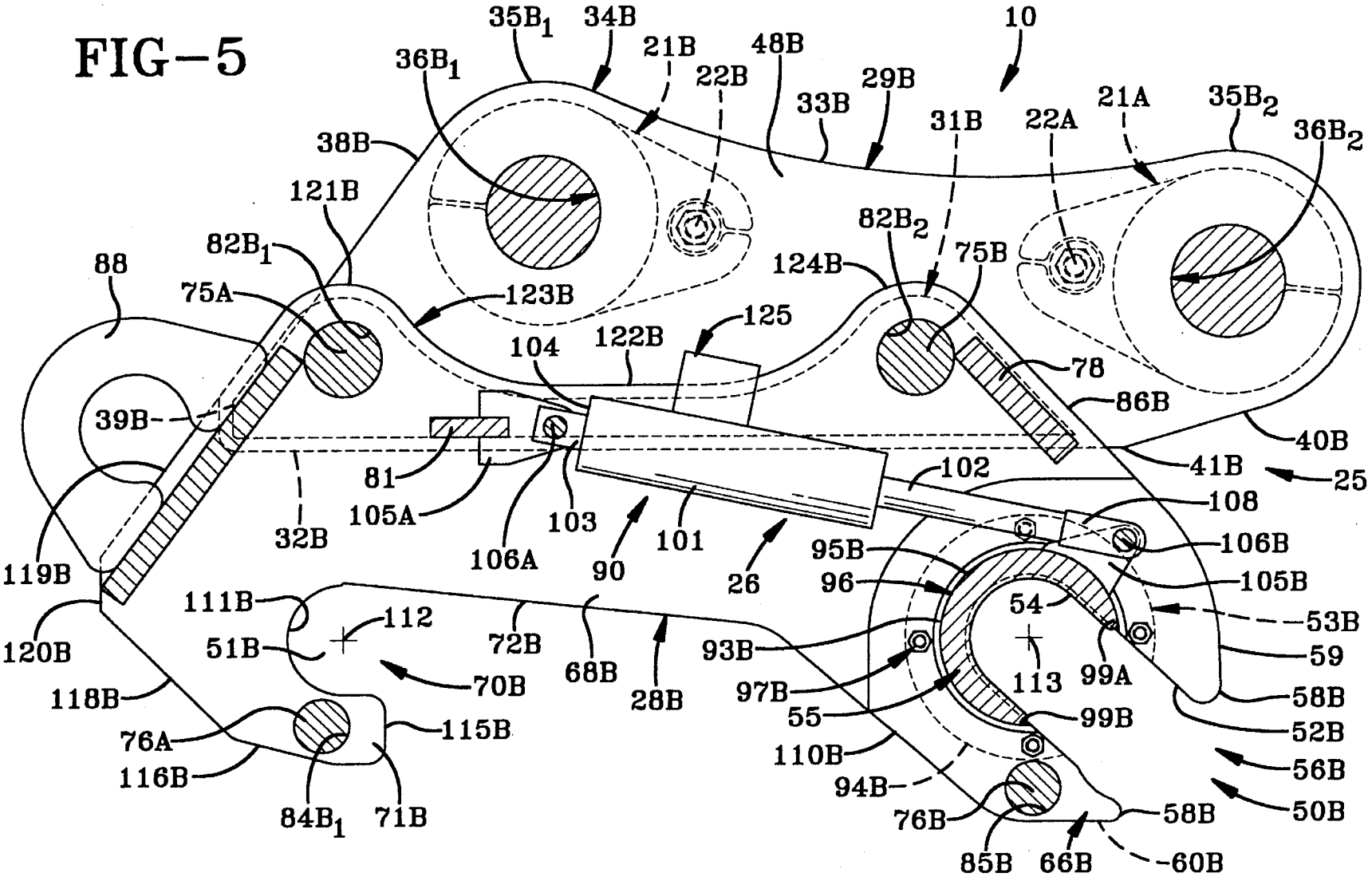
FIG. 5 is a cross-sectional view of the coupler, FIG. 5 being taken substantially along line 5—5 of FIG. 3.

The first mounting-pin receiving slots 50 are assisted in the function of guiding the first mounting pin 62 by the C-shaped recess defined by the interior surface 54 of the rotator member 55 in the locking sub-assembly 26 when the rotator member 55 is in its hereinafter described second position, as shown in FIG. 5. As will become apparent in the description that follows, the C-shaped recess defined by the interior surface 54 primarily serves as the locking means to retain the first mounting pin 62 when the rotator member 55 is in its first position, as depicted in FIG. 13B and a portion thereof may serve as a bearing surface rotatably to engage the hereinafter described discontinuous annular bushings 93.

The mouths 56A and 56B of the first mounting-pin receiving slots 50A and 50B open generally forwardly through the frontal portions 58A and 58B of each side plate 28A and 28B. The mouths 56A and 56B are defined by spaced, and opposed, upper and lower jaws 59 and 60. The first mounting-pin receiving slots 50A and 50B extend obliquely upwardly and rearwardly from the frontal portions 58A and 58B of the side plates 28A and 28B at approximately a thirty-seven degree angle (37°) to terminate in the apices 61A and 61B at the rear of the respective slots 50A and 50B. It should be understood that the aforesaid thirty-seven degree angle (37°) is deemed to be the optimum, but angles falling in the range of from about thirty degrees (30°) to about forty-five degrees (45°) would suffice.

The apices 61A and 61B of the first mounting-pin receiving slots 50A and 50B are each of a preferably cylindrical configuration in order to receive the rotator member 55 for rotation between its first and second positions. It is the C-shaped recess 54 of the rotator member 55—together with the slotted recess 65 in the bearing support plates 66—that combine to receive, and virtually encapsulate, the first laterally extending mounting pin 62 that is secured to the work implement 11 and allow the mounting pin 62 slidingly to translate along the first mounting-pin receiving slots 50A and 50B and into the C-shaped recess 54.

Figure 8:
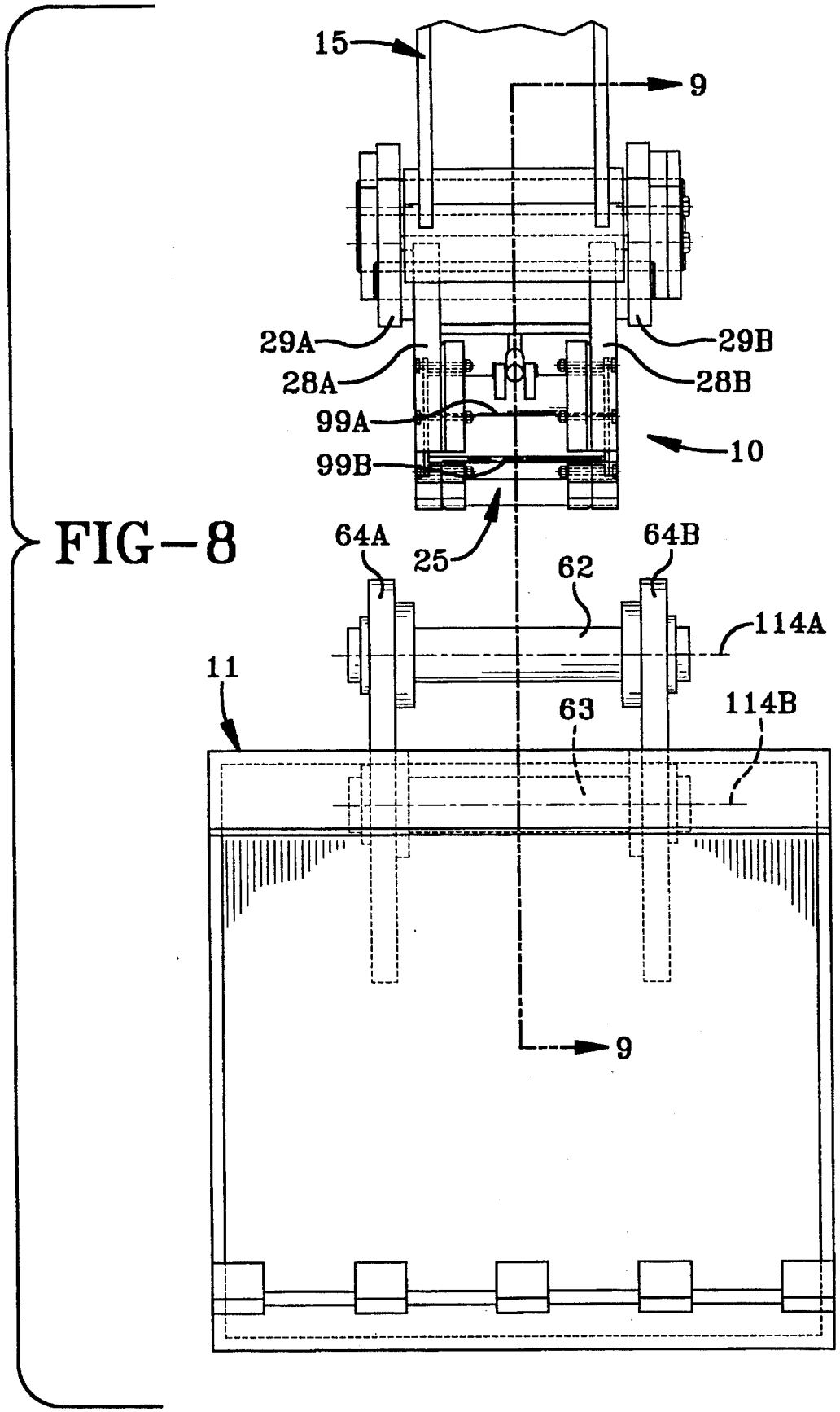
FIG. 8 is an enlarged frontal elevation of the backhoe bucket and the coupler assembly, FIG. 8 being taken substantially along the line 8—8 of FIG. 7.

As best shown in FIG. 8, the first and second mounting pins 62 and 63 may extend laterally, in longitudinally spaced relation, between the attaching plates 64A and 64B that project upwardly from the work implement, such as the backhoe bucket, 11. Because the first mounting pin 62 is slidably receivable along substantially the full extent of the first, parallel, laterally spaced, mounting-pin receiving slots 50A and 50B, as well as the C-shaped recess 54 in the rotator member 55 and the slotted recesses 65A and 65B in the bearing support plates 66, the cross-span dimension of the C-shaped recess 54—and the cross-span dimension of the slotted recesses 65A and 62B—are substantially equal to the diameter of the first mounting pin 62. Even the slotted recesses 52A and 52B in the rotator retaining plates 53A and 53B must have a cross-span dimension that will accommodate the diameter of the first mounting pin 62.

The mouths 56A and 56B of each first mounting-pin receiving slot 50A and 50B are not only defined by the cross-span dimension between the opposed jaws 59 and 60 on the side plates 28 but are also further defined by the slotted recesses 65A and 65B in the bearing support plates 66A and 66B that are secured to the inwardly directed faces 68A and 68B of the respective side plates 28A and 28B.

The mouths 70A and 70B of the second mounting-pin receiving slots 51A and 51B are defined by the lower jaws 71A and 71B that are disposed in spaced opposition to the lower, guiding edges 72A and 72B on the side plates 28A and 28B. The guiding edges 72 constitute an extension of the sides of the slots 51 and serve an important role in the operation of the coupling assembly 10, as will be hereinafter more fully explained.

The description to this point should sufficiently familiarize one with the basics of the side plates 28, the mounting plates 29 and the general concepts as to at least the first mounting-pin receiving slots 50A and 50B. However, before continuing with a detailed description as to the configuration of the second mounting-pin receiving slots 51A and 51B—and the interaction achieved between the mounting-pin, receiving slots 50 and 51 to effect a fast-make coupling connection—some attention should now be directed to the structure by which the side plates 28 of the body portion 25 are connected.

Figure 6:
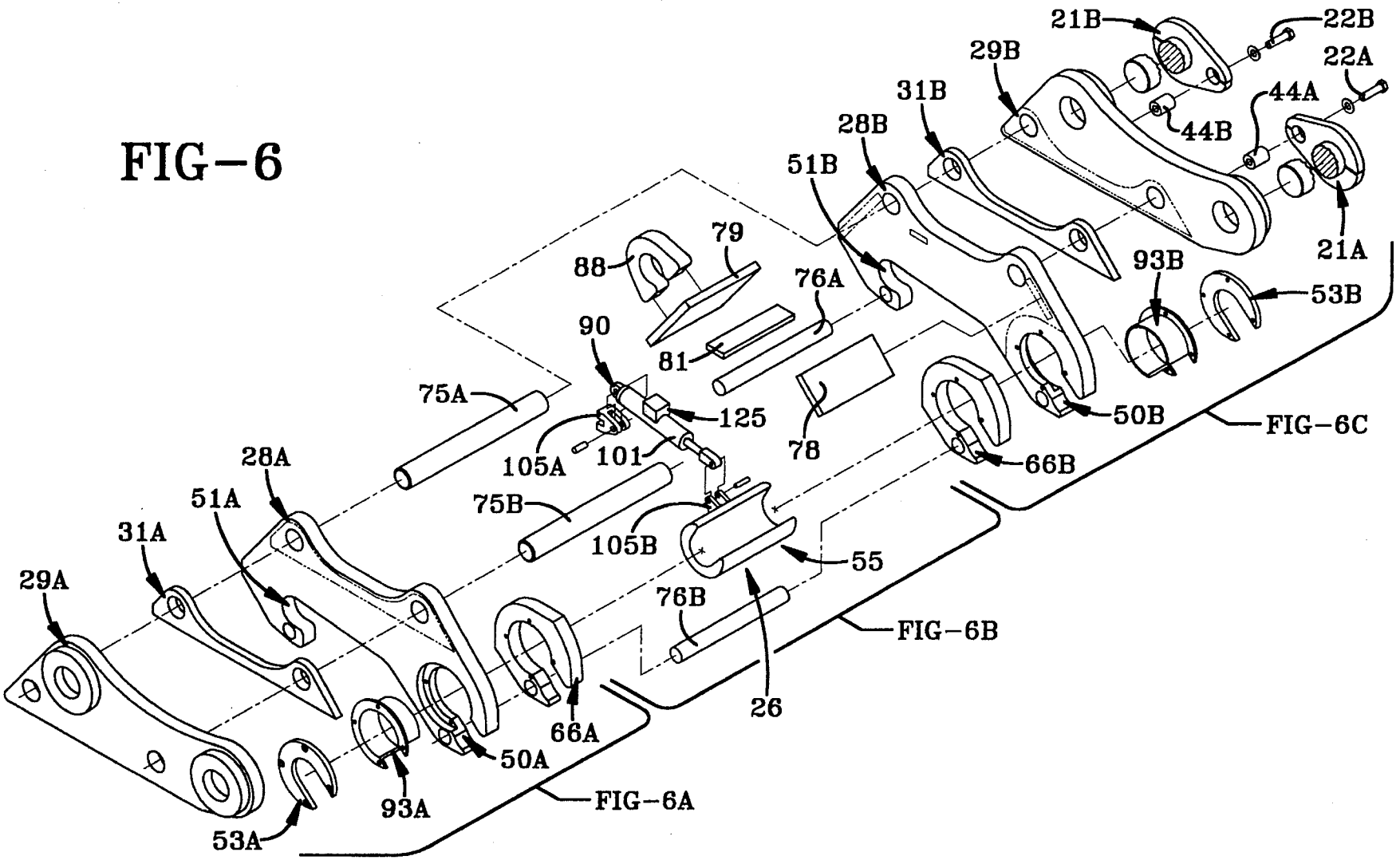
FIG. 6 is an exploded perspective of the fast-make coupler assembly depicted in the previous figures.
Figure 6A:
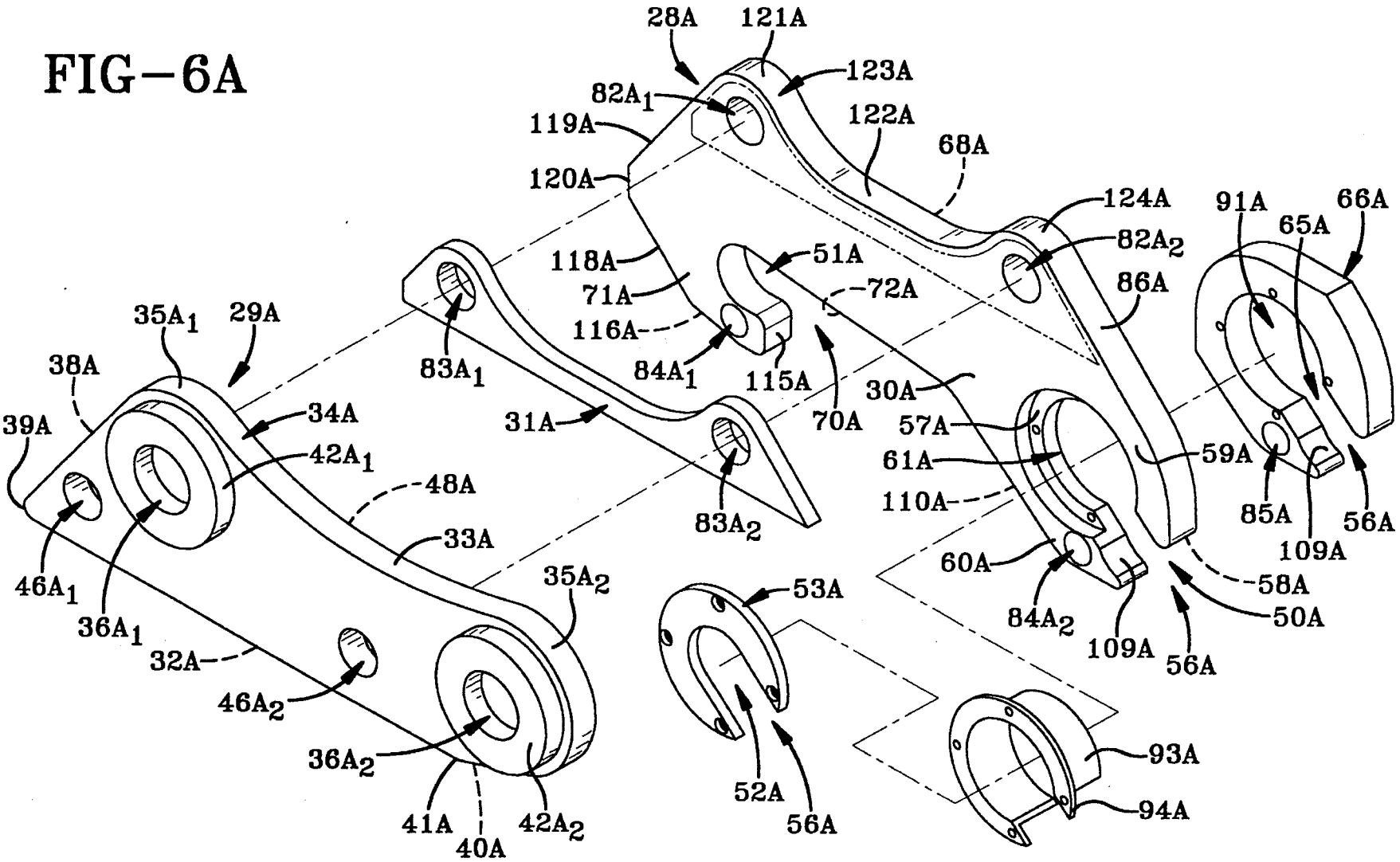
FIG. 6A is an enlarged perspective of that portion of FIG. 6 which is delineated by the brace designated as FIG. 6A on FIG. 6.
Figure 6B:
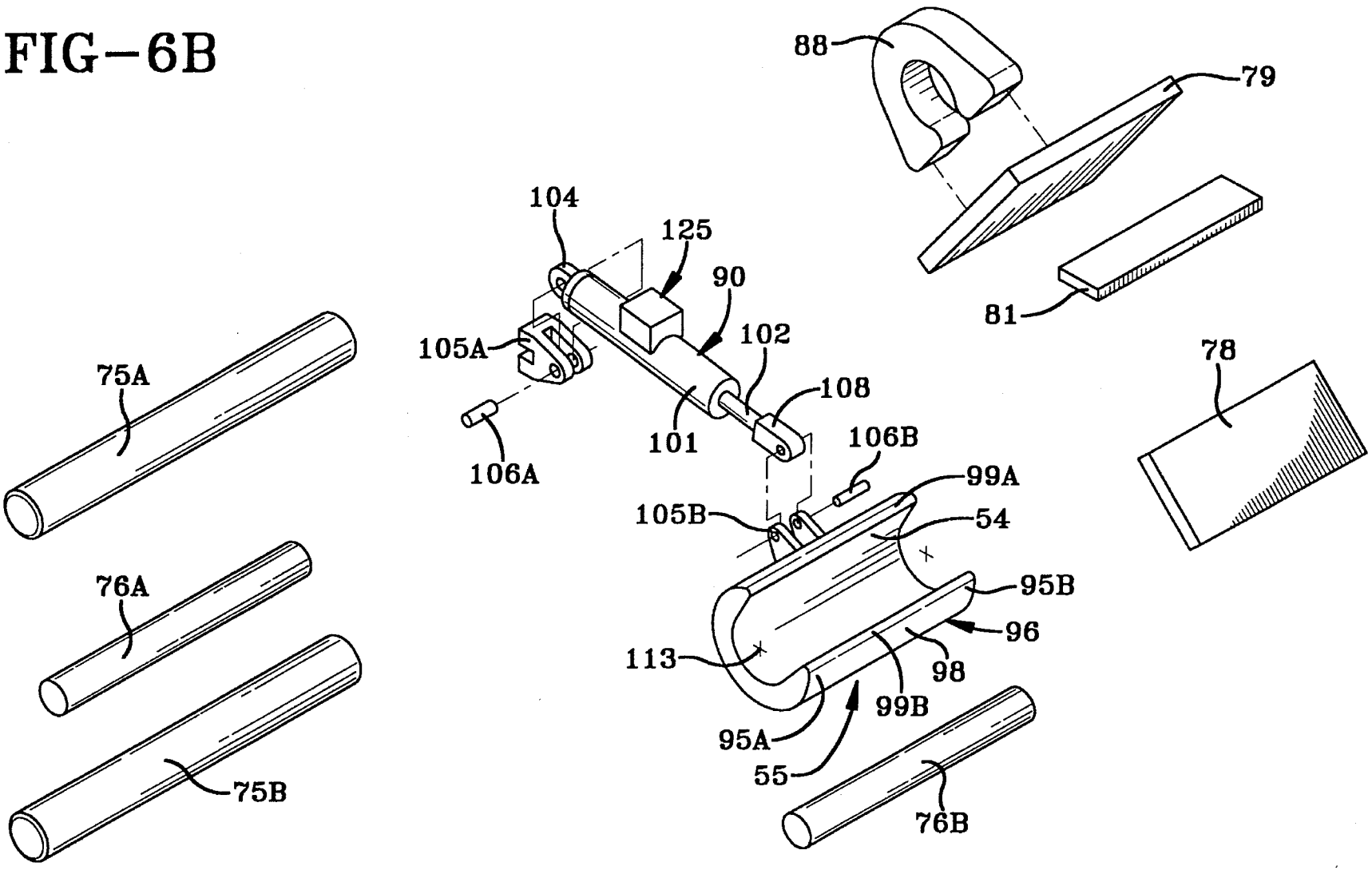
FIG. 6B is an enlarged perspective of that portion of FIG. 6 which is delineated by the brace designated as FIG. 6B on FIG. 6.
Figure 6C:
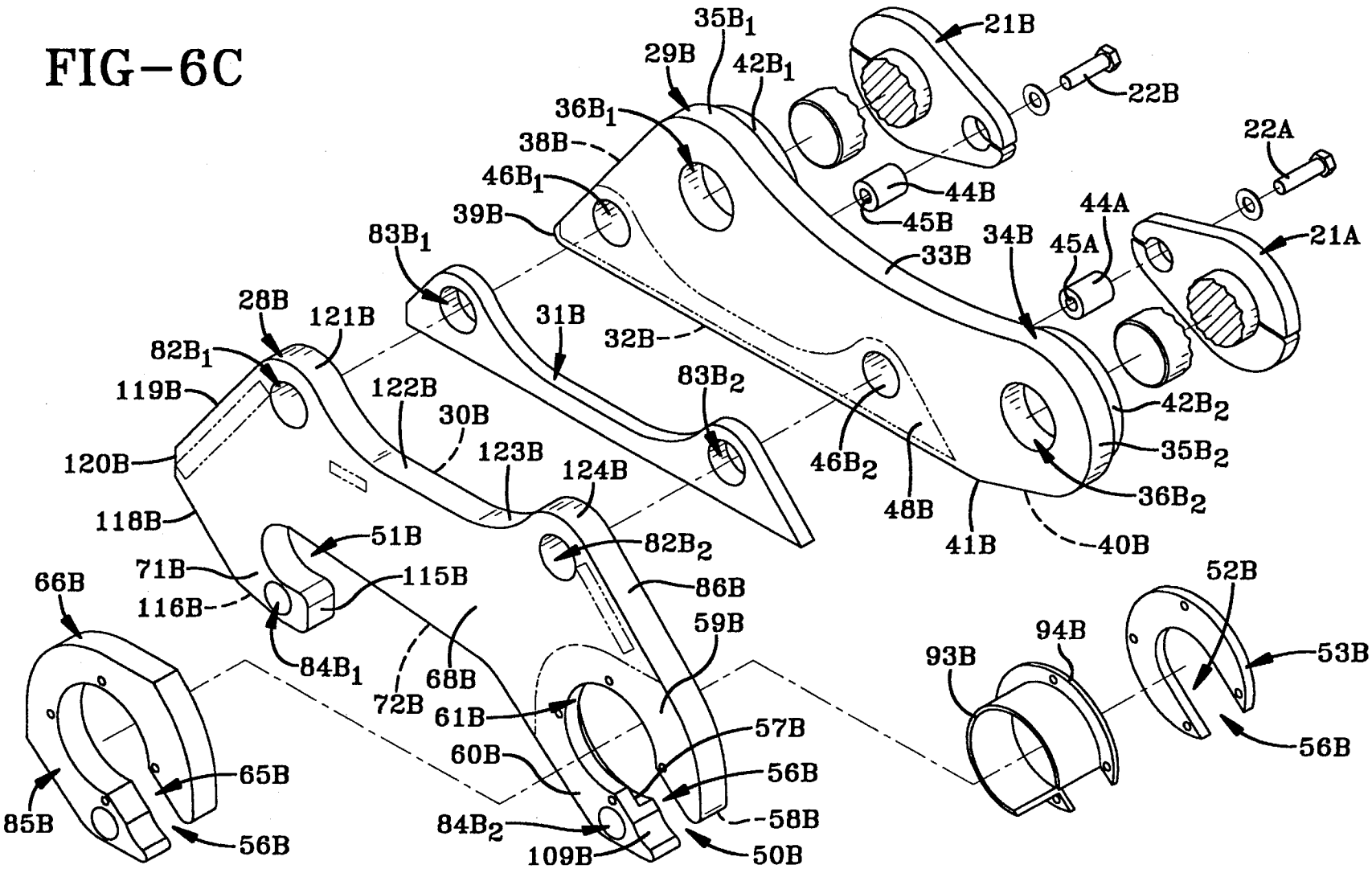
FIG. 6C is an enlarged perspective of that portion of FIG. 6 which is delineated by the brace designated as FIG. 6C on FIG. 6.

Stabilization of the body portion 25 may be achieved by using a pair of, preferably cylindrical, upper cross-bars, or tie rods, 75A and 75B (most clearly identified on FIG. 6B) and a pair of, preferably cylindrical, lower cross-bars, or tie rods, 76A and 76B that act in opposition to the forward and rear spacer plates 78 and 79, respectively, and the piston/cylinder mounting plate 81, all of which extend transversely between the laterally spaced side plates 28A and 28B.

The upper cross-bar 75A is received in the cross-bar apertures 46$A_1$ and 46$B_1$ that penetrate the mounting plates 29A and 29B and which register with each other as well as with corresponding cross-bar apertures 82$A_1$ and 82$B_1$ in the side plates 28A and 28B and the corresponding cross-bar apertures 83$A_1$ and 83$B_1$ in the shim plates 31A and 31B, respectively, which may or may not be required for spacing. The cross-bar 75A need only be secured, as by welding, to the mounting plates 29A and 29B. The upper cross-bar 75B is received in the cross-bar apertures 46$A_2$ and 46$B_2$ that penetrate the mounting plates 29A and 29B and which register with each other as well as with the corresponding cross-bar apertures 82$A_2$ and 82$B_2$ in the side plates 28A and 28B and the corresponding cross-bar apertures 83$A_2$ and 83$B_2$ in the shim plates 31A and 31B, respectively. The cross-bar 75B may similarly be secured, as by welding, only to the mounting plates 29A and 29B.

The lower cross-bar 76A is similarly received in cross-bar apertures 84$A_1$ and 84$B_1$ that penetrate the lower jaws 71A and 71B in the mouths 70A and 70B, respectively, of the second mounting-pin receiving slots 51A and 51B so as to register with each other. The lower cross-bar 76B is received in the cross-bar apertures 84$A_2$ and 84$B_2$ that penetrate the lower jaws 60A and 60B in the mouths 56A and 56B of the first mounting-pin receiving slots 50A and 50B so as to register with each other as well as the corresponding cross-bar apertures 85A and 85B in the bearing support plates 66A and 66B. The lower cross-bar 76A and 76B, however, need only be secured, as by welding, to the side plates 28A and 28B.

The aforesaid cross-bars, or tie rods, 75 and 76 operate in opposition to the spacer plates, as follows. The forward spacer plate 78 may be a generally rectangular, compressive member located in substantially parallel alignment with the slanted, upper surfaces 86A and 86B on the upper jaws 59A and 59B of the mouths 56A and 56B for the first mounting-pin receiving slots 50A and 50B in side plates 28A and 28B, respectively.

The rear cross plate 79 may be a generally rectangular, compressive member located in substantial parallel alignment with the slanted rear edges 38A and 38B of the mounting plates 29A and 29B. The rear cross plate 79 also serves as a bracket member from which a lifting-eye receiving member 88 is secured, as by welding. The lifting-eye receiving member 88 may, as depicted, be preferably centered between the side plates 28.

The piston/cylinder mounting plate 81 extends transversely between the inwardly directed faces 68A and 68B of the side plates 28A and 28B sufficiently rearwardly of the rotator member 55 such that the piston/cylinder arrangement 90 can be operatively mounted therebetween.

The bearing support plates 66A and 66B, which are applied to the respective inwardly directed faces 68A and 68B of the respective side plates 28A and 28B, have slotted recesses 65A and 65B that terminate in substantially cylindrical apices 91A and 91B of generally C-shaped profile, the profiles of which are congruent with the profiles of the first mounting-pin receiving slots 50A and 50B, and the apices 61A and 61B thereof. As such, the slots 50A and 50B in the side plates 28A and 28B as well as the slots 65A and 65B in the rotator retaining plates 53A and 53B may combine to form a recessed thrust bearing and journal cavity 92 (FIG. 3) into which the circumferentially interrupted annular bushings 93A and 93B may be received. The bushings 93 must be secured against rotation such that the circumferential discontinuity remains aligned with the first mounting-pin receiving slots 50A and 50B. The bushings 93A and 93B may be conveniently so secured by utilizing radially extending flange portions 94A and 94B that are concentrically recessed into the base of the respective recesses 57A and 57B provided in the outwardly directed faces 30A and 30B of the side plates 28A and 28B to receive the rotator retaining plates 53A and 53B.

A plurality of nut and bolt combinations 97 are preferably countersunk in the outer side of each rotator retaining plate 53 and penetrate each side plate 28 as well as the appropriate bearing support plate 66 to permit facile access to each end portion of the rotator member 55. The nut and bolt combinations 97 thus assure that both the circumferential discontinuity of the bushings 93 and the slotted recesses 52 in the rotator retaining plates 53 remain aligned with the first mounting-pin receiving slots 50A and 50B. As such, the discontinuity in the bushings 93A and 93B will remain aligned with the C-shaped profile of the apices 61A and 61B in the side plates 28A and 28B as well as the C-shaped profile of the apices 91A and 91B in the bearing support plates 66A and 66B. The cylindrical end, or journal portions 95A and 95B on the exterior surface 96 of the rotator member 55 may be rotatably received within the respective bushings 93A and 93B.

At least the central portion 98 on the exterior surface 96 of the rotator member 55, irrespective of its outer configuration (although the central portion may well be cylindrical, as shown), serves as an indicator by which visually to signal the disposition of the rotator member 55 to the operator, even when seated in the cab of the prime mover 13. That is, the central portion 98 faces the operator when the rotator member 55 is in its first position. As such, the central portion 98 on the exterior surface 96 of the rotator member 55 may be painted a bright color to enhance its visibility and thereby assure that the operator can readily ascertain that the rotator member 55 is in its first, and locking, position.

Figure 9:
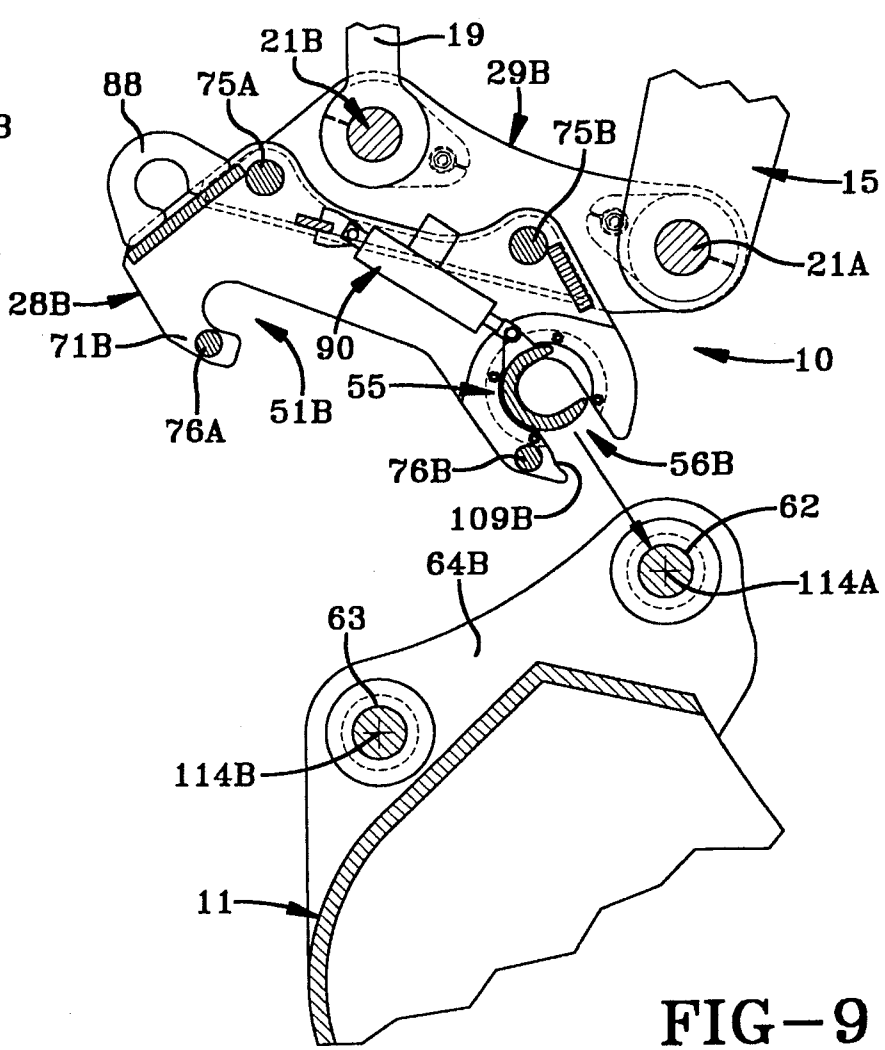
FIG. 9 is a cross-sectional view of the backhoe bucket and the coupler assembly, FIG. 9 being taken substantially along the line 9—9 of FIG. 8, and FIG. 9 appears on the same sheet of drawings as FIG. 7.

The central portion 98 may also serve as an optional secondary locator for the work implement 11 when the rotator member 55 is in its first position, as shown in FIGS. 9 and 12B. If the central portion 98 is cylindrical, a portion of each journal portion 95A and 95B may also assist in serving as the optional, secondary implement locator when the rotator member 55 is in its first position. At this point it should be observed that as the C-shaped interior surface 54 of the rotator member 55 penetrates the exterior surface 96, upper and lower lips 99A and 99B are defined, and the lips 99 extend the full longitudinal extent of the rotator member 55.

The base 100 of the recessed journal cavity 92 (formed by the significant differences in the shape of the slotted recesses 91A and 91B of the bearing support plates 66A and 66B and the congruent slots 50A and 50B in the side plates 28A and 28B in relation to the slots 52A and 52B in the rotator retaining plates 53A and 53B) constitutes a thrust-bearing surface by which the axis of the rotator member 55 is retained transversely with respect to the body portion 25.

To focus with greater detail on the locking sub-assembly 26, it will now be observed that the locking sub-assembly 26 is comprised generally of a means for effecting selective rotation thereof. The rotator member 55 may be conveniently actuated by a piston/cylinder arrangement 90, although the rotator member 55 can achieve most objects of the present invention when operated by any other automatic, or manually operated, actuating device one might wish to substitute therefor. Hence, if employed, the piston/cylinder arrangement 90 may be a conventional hydraulic variety having a cylinder 101 with a piston rod 102 extending axially outwardly from the cylinder 101. A mounting ring 103 may be secured to the base 104 of the cylinder 101. The mounting ring 103 extends orthogonally outward from the base 104 to be received within a clevis 105A that is mounted on the piston/cylinder mounting plate 81. The connection between the mounting ring 103 and the clevis 105A may be secured by a pivot pin 106A.

A clevis 105B may also be secured to the exterior surface 96 of the rotator member 55, and the outer end portion 108 of the piston rod 102 is received within the clevis 105B to be connected thereto by a pivot pin 106B. As such, the rotator member 55 extends laterally between the side plates 28 to be rotatably moveable between at least a first and a second position by the operative action of the piston/cylinder arrangement 90.

Returning to the detailed description of the side plates 28A and 28B, the lower jaw 60 at the mouth 56 of each first mounting-pin receiving slot 50A and 50B is also provided with a relatively shallow, transversely extending, arcuate, locating recess 109A and 109B that is also of preferably equal radius to that of the first mounting pin 62. The arcuate locating recesses 109 also extend laterally across the slotted recesses 65 in the adjacent bearing support plates 66, for a reason that will be hereinafter more fully explained.

The guiding edge 72A and 72B on the respective side plates 28A and 28B joins an inclined portion 110A or 110B that extends obliquely forwardly and downwardly to be disposed in substantially parallel relation with the first mounting-pin receiving slots 50A and 50B and to serve as the under surface of the lower jaw 60. Conversely, the guiding edges 72A and 72B extend to, and merge with, the closed, preferably cylindrical, apices 111A and 111B of the second mounting-pin receiving slots 51A and 51B. It can now be observed that the common axis 112 of the preferably cylindrical apices 111A and 111B and the axis 113 of the rotator member 55 are spaced at substantially the same distance as the distance between the axes 114A and 114B (FIG. 9) of the first and second mounting pins 62 and 63, respectively, for a reason that will also hereinafter become more apparent.

As will also become apparent, it is important to the operation of the coupler assembly 10 that the spacing between the centers of the locating recesses 109 and the blocking shoulders 115A and 115B (as described in the next paragraph) on the lower jaws 71A and 71B of the second mounting-pin receiving slots 51A and 51B be slightly greater than the span between the axes 114A and 114B of the mounting pins 62 and 63—assuming that the pins 62 and 63 have the same diameter, which is the standard arrangement. However, if the pins are not of the same diameter, one would determine the span of the pins 62 and 63 from the outer edges that are presented rearwardly, with reference to the arbitrarily designated front and rear of the coupler assembly 10. It should also be noted that if the exterior surface 96 is to serve as an optional, secondary locator for the work implement 11 during the coupling process, the spacing between the axis 113 of the rotator member 55 and the blocking shoulders 115 would itself also be slightly greater than the span between the axes 114A and 114B of the mounting pins 62 and 63.

As is perhaps best seen in FIG. 5, the lower jaws 71A and 71B of the second mounting-pin receiving slots 51A and 51B present forwardly facing, blocking shoulders 115A and 115B, and the under edges 116A and 116B on the lower jaws 71A and 71B of the second mounting-pin receiving slots 51A and 51B terminate in downwardly facing, upwardly and rearwardly inclined, edges 118A and 118B. The inclined edges 118A and 118B join the upwardly and forwardly inclined rear edges 119A and 119B through haunched connecting edges 120A and 120B. The inclined edges 119A and 119B merge into circumferential portions 121A and 121B that extend concentrically about the pin-receiving apertures $82A_1$ and $82B_1$. The central portion 122 of the upper edge 123 may also be curvilinear to provide operational clearance for the work implement and/or to minimize weight. The rear of the curvilinear central portions 122 also merges with the circumferential portions 121A and 121B, and the front of the central, curvilinear portion 122 merges with the circumferential portions 124A and 124B that extend concentrically about the pin-receiving apertures $82A_2$ and $82B_2$. To complete the description for the peripheral profile of the side plates 28A and 28B, the circumferential portions 124A and 124B merge into the upper surfaces 86A and 86B on the upper jaws 59A and 59B.

A pilot-operated check valve 125 may be provided when a cylinder 101 is used to actuate the rotator member 55. The check valve 125 assures that even if the hydraulic line to the cylinder 101 should break, the rotator member 55 will not be released. As is known, the use of a pilot-operated check valve 125 requires that positive fluid pressure be applied to the valve 125 before the valve 125 will open. This fail-safe feature, while not necessary to the operation of the coupler assembly 10, is obviously a desirable, and highly recommended, option.

Although not shown, when a hydraulic cylinder 101 is incorporated in the locking sub-assembly 26, the cylinder 101 may be connected to the hydraulic control system of the prime mover 13. Selective actuation of the various piston/cylinders 16 is employed to manipulate the articulation of the boom 12 and the orientation of the coupler assembly 10 relative to the outer end portion of the distal boom arm 15. The cylinder 101 is actuated selectively to rotate the rotator member 55 between a first and a second position—as more fully explained in conjunction with the operation of the coupler assembly 10—and hereby assist in achieving a facile connection between the work implement 11 and the articulating boom 12.

Operation

The novel manner in which a work implement, such as the backhoe bucket, 11 may be demountably attached to the prime mover 13 by virtue of the new and novel fast-make coupler assembly 10 will now be described with reference to FIGS. 7 through 13B.

Figure 7:
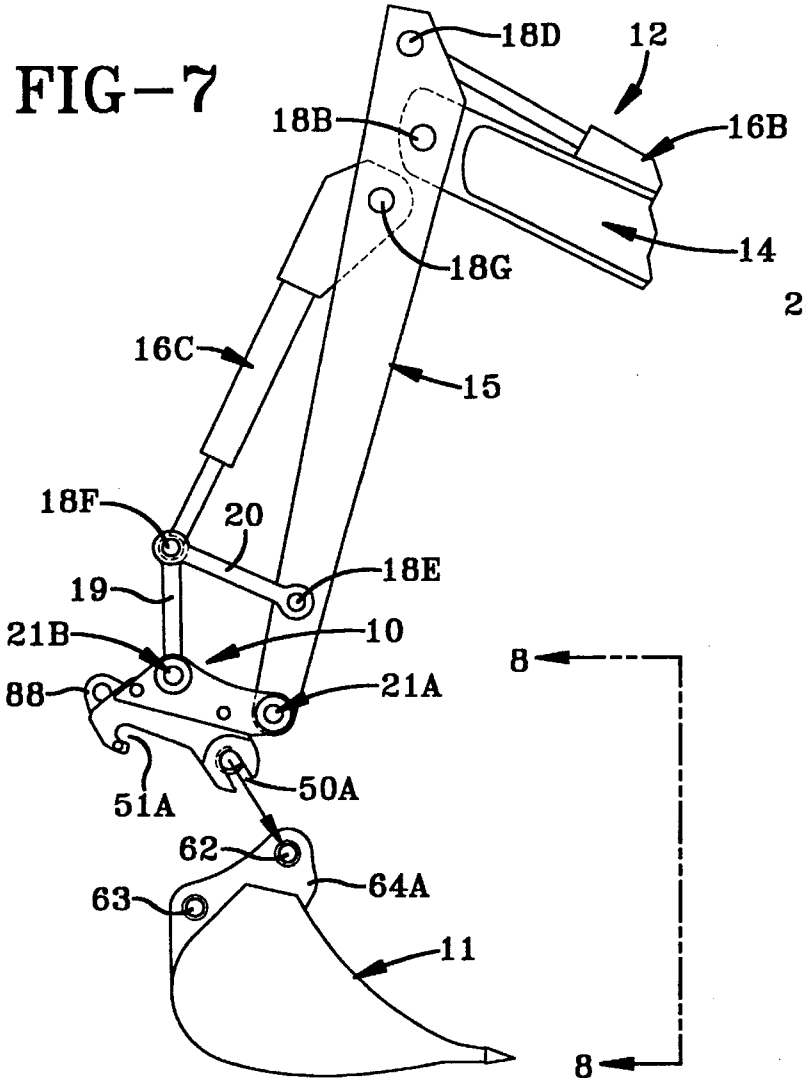
FIG. 7 is a side elevational view similar to a portion of FIG. 1 but showing the backhoe bucket detached from the articulating boom, and with the fast-make coupler assembly poised to engage the mounting bracket on the backhoe bucket—the rotator member being disposed in what is designated as its first position.

With particular reference to FIGS. 7, 8 and 9, the work implement 11 is depicted in a disconnected state. The novel coupler assembly 10 is operatively connected to the prime mover 13 and positioned relative to the work implement 11 so as to permit initiation of the coupling sequence. The lateral, inside dimension between the plates 64A and 64B on the work implement 11 must be slightly wider than the outside dimension of the side plates 28A and 28B on the main body portion 25 of the coupler assembly 10 in order for physical coupling to be achieved. However, the dimensions must be reasonably close in order to preclude undesired looseness between the coupler assembly 10 and the work implement 11 mounted thereon.

Upon completion of the coupling sequence, the mounting pin 62 will be received within, and be engaged by, the surface 54 defining the C-shaped interior of the rotator member 55 that extends transversely between the apices of the first mounting-pin receiving slots 50A and 50B. The second mounting pin 63 will be received within the transversely registered, second mounting-pin receiving slots 51A and 51B. It should also be appreciated that the mounting pins 62 and 63 may be reversed relative to the coupler assembly 10. That is, the work implement 11 may be reversed relative to the coupler assembly 10, in which situation the designation as to which is the first and second mounting pins 62 and 63 would be reversed. That is, the former second pin 63 would become the first pin. As such, the backhoe bucket depicted could, with the present coupler assembly 10, be mounted to serve as a standard excavating bucket with the primary work stroke being forwardly, and away, from the prime mover 13.

It should be understood that the coupler assembly 10 may, if desired, be reversed with respect to the boom arm 15 on which it is mounted. Such an approach would not afford all the advantages achieved by the coupler assembly 10 in the orientation depicted herein, but such an orientation, if used, is deemed to be within the scope of the present invention.

As shown in FIGS. 7 and 9, the coupling sequence is initiated by bringing the first mounting-pin receiving slots 50A and 50B on the coupler assembly 10 into proper orientation with the first mounting pin 62 presented from the work implement 11 so that the first mounting-pin receiving slots 50A and 50B are positioned slightly above and behind the first mounting pin 62 on the work implement 11. If the rotator member 55 is in its first position, as depicted in FIG. 9, the rotator member 55 is in the proper position to serve as the optional secondary locating member.

Figure 10A:
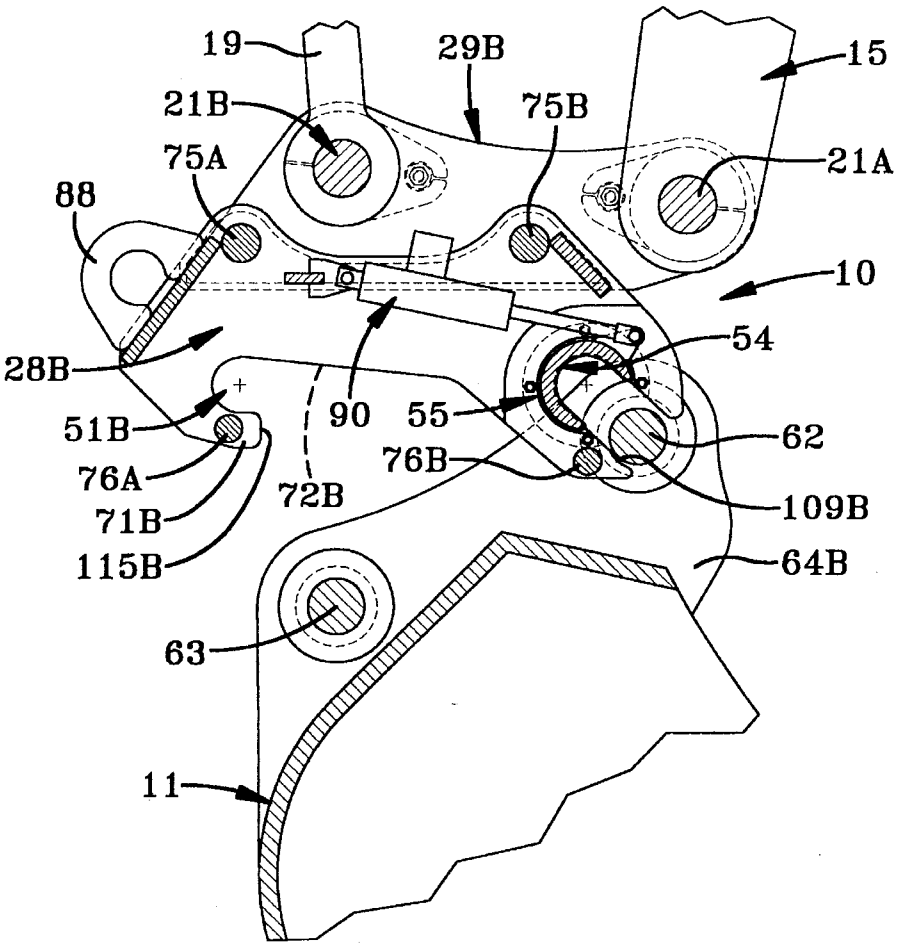
FIG. 10A is an enlarged, sagittal cross-section that extends substantially within that portion of FIG. 10 delineated by the chain-line circle that is designated as FIG. 10A on FIG. 10.
Figure 10:
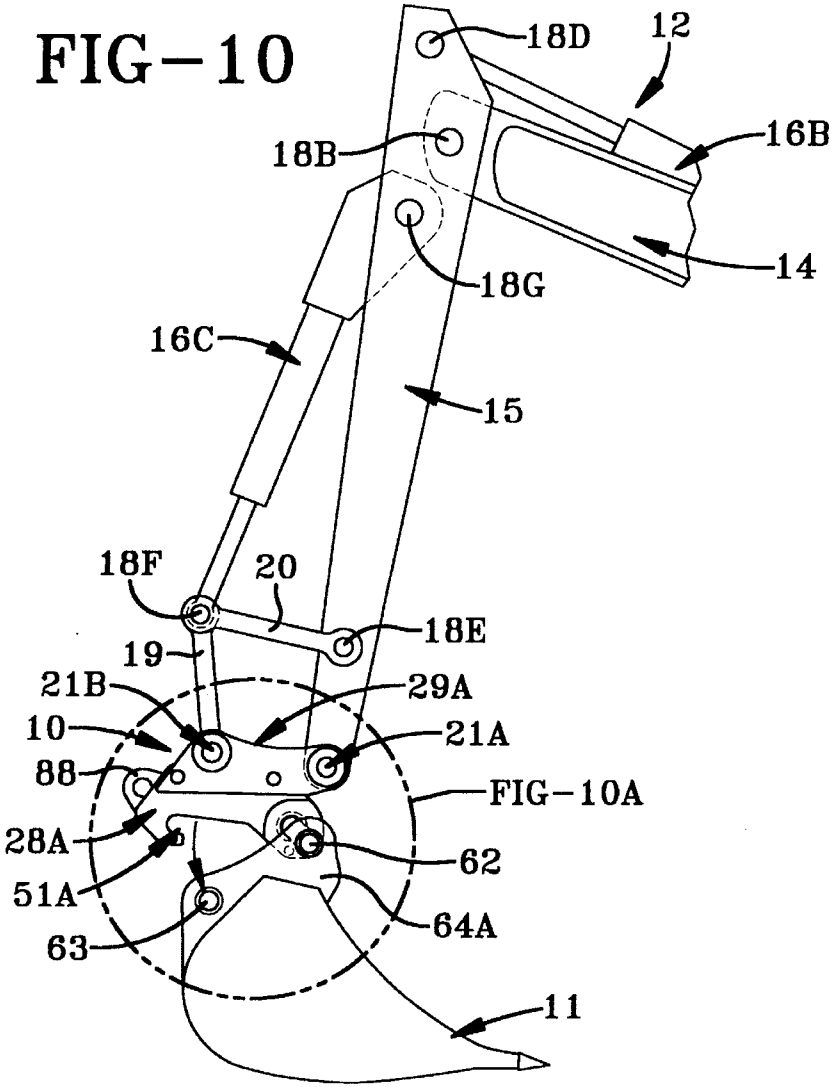
FIG. 10 is a side elevational view similar to FIG. 7 but depicting the first step in the coupling sequence.

However, if the rotator member 55 is to be operated in the preferred manner (wherein the recesses 109 serve as the sole locating means), the rotator member 55 is rotated to its second position, as depicted in FIG. 10. With the rotator member 55 so disposed, the coupler assembly 10 is manipulated (by artfully combined, and individual, movement of both the articulating boom 12 and the coupler assembly 10 mounted thereon) such that the mouths 56A and 56B of the first mounting-pin receiving slots 50A and 50B embrace the first mounting pin 62. Movement of the coupler assembly 10 is continued until the mounting pin 62 has slidingly entered the first mounting-pin receiving slots 50 sufficiently to engage the transversely extending locating recess 109, as is also depicted in FIG. 10A.

Figure 11A:
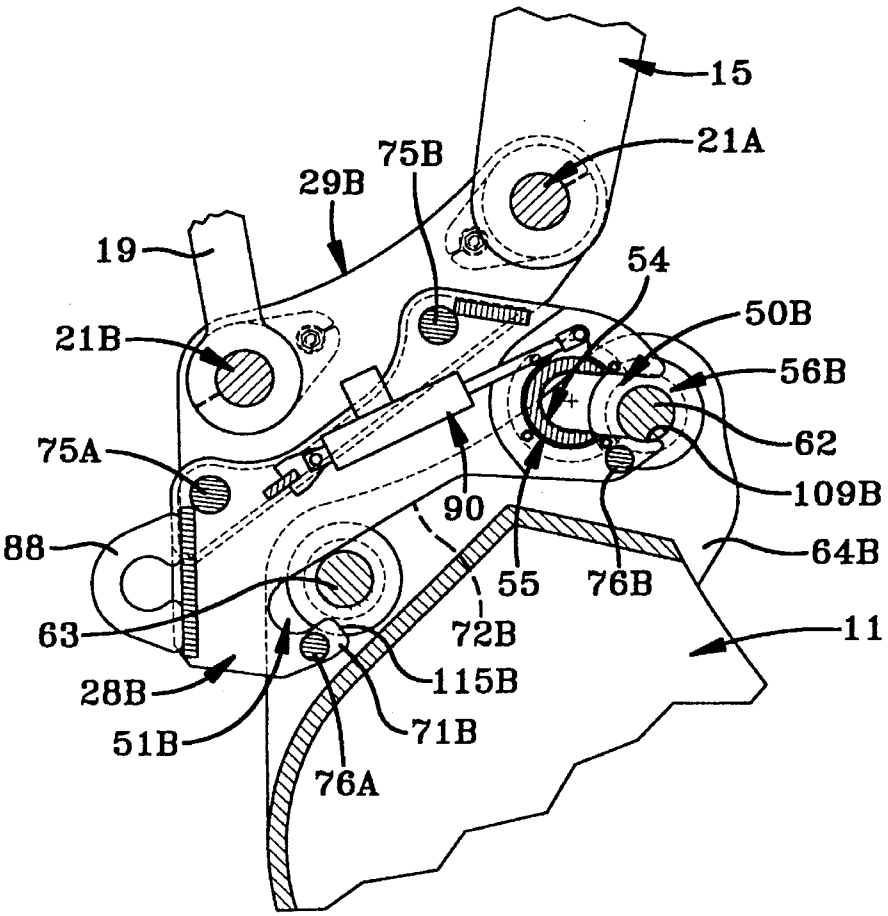
FIG. 11A is an enlarged, sagittal cross-section that extends substantially within that portion of FIG. 11 delineated by the chain-line circle that is designated as FIG. 11A on FIG. 11.
Figure 11:
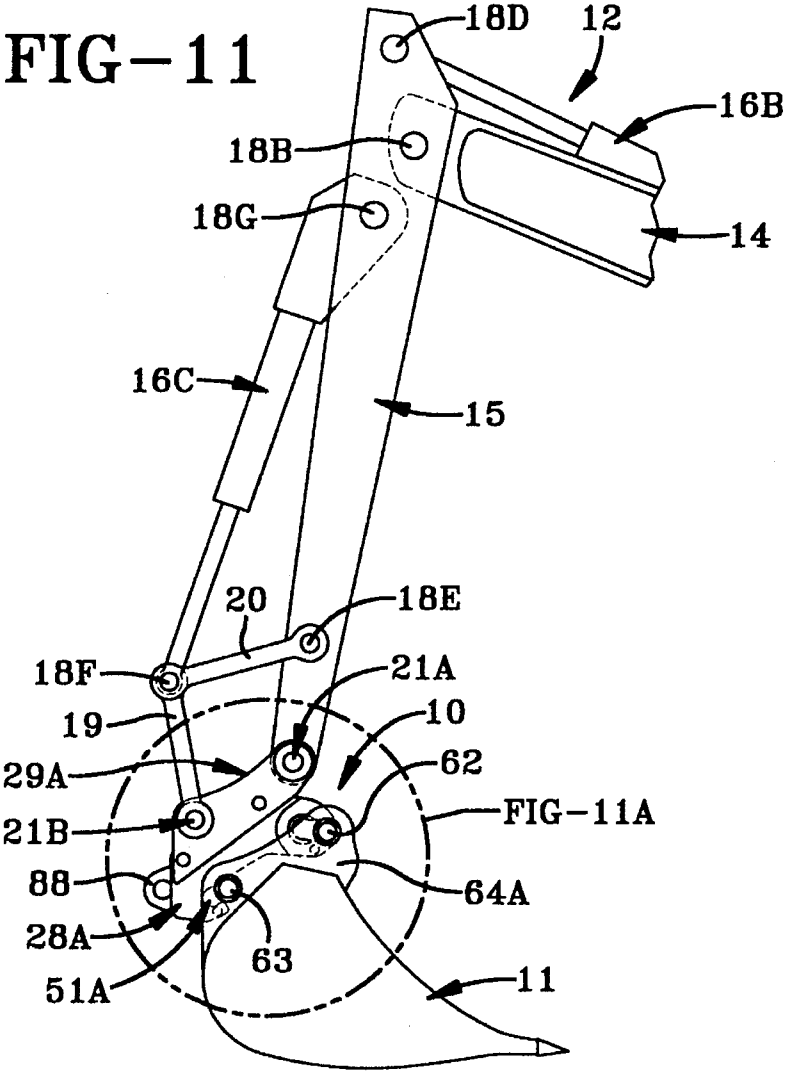
FIG. 11 is a view similar to FIG. 10, but showing the second step in the coupling sequence.

As the coupler assembly is rotated in a counterclockwise direction, as viewed on the drawings, from the position depicted in FIGS. 10 and 10A to the position depicted in FIGS. 11 and 11A, the transversely extending, relatively shallow, arcuate, locating recesses 109 continue to contact, and retain, the mounting pin 62 within the slots 50 until the coupler assembly 10 can be manipulated to the point that the second mounting pin 63 engages the guiding surfaces 72, as depicted in FIGS. 11 and 11A. For that position to be achieved, the dimensional relationship between the spacing of the locating recesses 109 relative to the blocking shoulders 115 on the lower jaws 71 of the second mounting-pin receiving slots 51 in relation to the spacing of the first and second mounting pins 62 and 63 on the work implement 11 is of extreme importance. To pass from the position represented in FIGS. 10 and 10A to the position depicted in FIGS. 11 and 11A, the second mounting pin 63 must swing past the blocking shoulders 115 to engage the guiding edges 72 presented on the underside of the side plates 28.

As the coupler assembly 10 is rotated counterclockwise to the position depicted in FIGS. 11 and 11A—and on to the position depicted in FIGS. 12 and 12A—the weight of the work implement 11 will eventually cause the work implement 11 to drop such that the first mounting pin 62 will be received within the C-shaped recess 54 in the rotator member 55 and the second mounting pin 63 will be received within the second mounting-pin receiving slots 51.

Depending upon the exact configuration of the work implement it may also be necessary for the operator to manipulate the articulating boom 12 such that the outboard end portion of the distal arm 15 is raised in conjunction with the aforesaid rotation of the coupler assembly 10. Such movements are well within the ability of the accomplished operator and are not in the least unnatural.

When the work implement 11 and the coupler assembly 10 are disposed as depicted in FIGS. 12 and 12A, the piston/cylinder arrangement 90 is actuated to rotate the rotator member 55 in a counterclockwise direction from the second position back to its first position, as depicted in FIG. 12B. When the rotator member 55 is in its first position with the mounting pin 62 encapsulated therein, the rotator member is serving its locking function.

It should be noted that for the coupler assembly 10 to achieve its position relative to the distal boom arm 15 depicted in FIG. 12, the piston/cylinder 16C must preferably be fully extended such that the pressurized hydraulic fluid that operates piston/cylinder 16C will enter the pressure by-pass. Thus, to maximize safety, the cylinder 101 may be connected such that it operates only from the by-pass pressure supplied by piston/cylinder 16C when it is projected to the maximum extent, thereby assuring that cylinder 101 can not be actuated except when the coupler assembly 10 is disposed in the position depicted in FIG. 12.

When the work implement 11 is maintained in locking engagement with the improved coupler assembly 10, the articulating boom 12, as well as the coupler assembly 10, may be moved throughout their full ranges of motion without risk of the work implement 11 being inadvertently disconnected.

To disconnect the work implement 11 from the coupler assembly 10, the above sequence is simply reversed.

The foregoing description of the exemplary embodiment of the invention has been presented for the purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention and various embodiments and with various modifications as are suited to the particular use contemplated. All such modifications and variations are within the scope of the invention as determined by the appended claims when interpreted in accordance with the breadth to which they are fairly and legally entitled.

As should now be apparent, the present invention not only teaches that a coupling assembly embodying the concepts of the present invention permits facile assembly of a work implement to a prime mover, but also accomplishes the other objects of the invention.

We claim:

1. An improved coupler assembly for connecting a work implement which has laterally oriented, longitudinally spaced, first and second mounting pins to a prime mover, wherein the prime mover presents an articulating boom having a proximal and a distal arm and at least one articulating arm, the outer end portion of the distal arm and the articulating arm are adapted to be pivotally connected to the coupler assembly, the improved coupler assembly comprising:

a body portion having laterally spaced side plate means;

means to secure said body portion to both the distal arm and the articulating arm of the articulating boom presented from the prime mover;

first and second mounting-pin receiving slots in each said side plate means;

each of said mounting-pin receiving slots having an open mouth portion at one end thereof and an apex portion at the other end thereof;

said first and second mounting-pin receiving slots oriented sequentially to receive the respective first and second mounting pins in said mouth portions;

the dimension from said mouth to said apices of said first mounting-pin receiving slots being greater than the corresponding dimension of said second mounting-pin receiving slots;

locating means in said mouth portions of said first mounting-pin receiving slots such that the first mounting pin may be retained within said mouth portion of said first mounting-pin receiving slots before the second mounting pin is received within said mouth portions of said second mounting-pin receiving slots;

rotator means extending laterally between said apex portions of said first mounting-pin receiving slots in said laterally spaced, side plate means;

said rotator means mounted for rotational movement between at least a first and a second position;

said rotator means being oriented to engage the first mounting pin when said rotator means is in said first position, lockingly to retain the first mounting pin within said apices of said first mounting-pin receiving slots;

said rotator means also being oriented, when in said second position, selectively to permit the first mounting pin to slide along said first mounting-pin receiving slots after the second mounting pin is in substantial alignment above said second mounting-pin receiving slots; and, means selectively to move said rotator means between said first and second positions.

2. An improved coupler assembly, as set forth in claim 1, wherein said rotator means further comprises:

an exterior surface;

said exterior surface having journal portions to permit said rotator means to be rotatably supported in the apices of said first mounting-pin receiving slots;

said exterior surface also having a central portion;

at least said central portion adapted to present indicator means when said rotator means is in said first position.

3. An improved coupler assembly, as set forth in claim 1, wherein said rotator means further comprises:

an interior surface defining a C-shaped recess that opens through said exterior surface;

said C-shaped recess being open to the mouth portion of said first mounting-pin receiving slots when said rotator means is in said second position; and, said C-shaped recess being closed to the mouth portion of said first mounting-pin receiving slots when said rotator means is in said first position.

4. An improved coupler assembly, as set forth in claim 3, wherein:

the first mounting pin is adapted to be received within said C-shaped recess in said rotator means;

said rotator means being rotatable between said first and second positions, and vice versa, even when the first mounting pin is received within said C-shaped recess in said rotator means.

5. An improved coupler arrangement, as set forth in claim 4, wherein said coupler assembly further comprises:

a guiding surface on each said side plate means; and, a jaw located in spaced relation with respect to said guiding surface on each said side plate means to define said second mounting-pin receiving slots.

6. An improved coupler assembly, as set forth in claim 5, wherein:

said jaw terminates in a blocking shoulder;

the dimensional span between said locating means and said blocking shoulder is greater than the dimensional span of the first and second mounting pins.

7. An improved coupler assembly, as set forth in claim 6, wherein:

said jaw terminates in a blocking shoulder;

locator recesses serve as said locating means; and, the dimensional span between said locator recesses and said blocking shoulder is greater than the dimensional span of said first and second mounting pins.

8. An improved coupler assembly, as set forth in claim 6, wherein:

said jaw terminates in a blocking shoulder;

a locator member serves as said locating means; and, the dimensional span between said locator member and said blocking shoulder is greater than the dimensional span of said first and second mounting pins.

9. An improved coupler assembly, as set forth in claim 6, wherein:

said mouth portions of said second mounting-pin receiving slots face substantially forwardly; and, said mouth portions of said first mounting-pin receiving slots face forwardly and downwardly within an angular range of from about thirty degrees (30°) to about forty-five degrees (45°) with respect to the mouths of said forwardly facing second mounting-pin receiving slots.

10. An improved coupler assembly, as set forth in claim 1, further comprising:

a pair of mounting plate means;

each said mounting plate means disposed partially above, and laterally outwardly of, said side plate means;

a pair of pivot-pin locking sub-assemblies to secure said body portion to both the distal arm and the articulating arm of the articulating boom;

one of said pivot-pin locking sub-assemblies securing said mounting plate means to the outboard end portion of the distal arm on the articulating boom; and, another of said pivot-pin locking sub-assemblies securing said mounting plate means to the articulating arm of the articulating boom.

11. An improved coupler assembly, as set forth in claim 10, wherein:

each of said mounting plate means has a plurality of cross-bar apertures therein;

each of said side plate means has a plurality of cross-bar apertures therein;

a plurality of cross-bars are received within said plurality of cross-bar apertures in said side plate means and also within said plurality of cross-bar apertures in said mounting plate means so as to connect said pair of mounting plate means with said side plate means and said side plate means to each other.

12. An improved coupler assembly, as set forth in claim 9, wherein said body portion further comprises:

a rear spacer plate interposed between said laterally spaced side plate means;

a front spacer plate interposed between said two side plate means; and, a piston/cylinder mounting plate interposed between said side plate means.

13. An improved coupler assembly, as set forth in claim 12, wherein said coupler assembly further comprises:

a lifting-eye receiving member mounted on said rear spacer plate.

14. An improved coupler assembly, as set forth in claim 13, further comprising:

a bearing recess in each of said side plate means adjacent to said first mounting-pin receiving slot;

said rotator means being interposed between said side plate means and also being journalled in said bearing recess.

15. An improved coupler assembly, as set forth in claim 1, wherein said means selectively to move said rotator means between first and second positions further comprises:

an actuating cylinder having a piston rod;

means for connecting said rotator means with said piston rod; and, means for mounting said actuating cylinder to said main body portion.

16. An improved coupler assembly for connecting a work implement which has laterally oriented, longitudinally spaced, first and second mounting pins to a prime mover, and wherein the prime mover presents an articulating boom having proximal and distal arms and at least one articulating arm, the improvement comprising:

a body portion having laterally spaced side plate means;

means to secure said body portion to both the distal arm and the articulating arm of the articulating boom presented from the prime mover;

first and second mounting-pin receiving slots in each said side plate means;

each of said mounting-pin receiving slots having an open mouth portion at one end thereof and an apex potion at the other end thereof;

rotator means extending laterally between said apex portions of said first mounting-pin receiving slots in said laterally spaced, side plate means;

said rotator means mounted for rotational movement between at least a first and a second position;

the dimensional span between said apices of said first and second mounting-pin receiving slots being substantially equal to the dimensional span of the first and second mounting pins;

said mouth portions of said second mounting-pin receiving slots face substantially forwardly; and, said mouth portions of said first mounting-pin receiving slots face forwardly and downwardly within an angular range of from about thirty degrees (30°) to about forty-five degrees (45°) with respect to the mouths of said forwardly facing second mounting-pin receiving slots.

17. An improved coupler assembly for connecting a work implement which has laterally oriented, longitudinally spaced, first and second mounting pins to a prime mover, and wherein the prime mover presents an articulating boom having proximal and distal arms and at least one articulating arm, the improvement comprising:

a body portion having laterally spaced side plate means;

means to secure said body portion to both the distal arm and the articulating arm of the articulating boom presented from the prime mover;

first and second mounting-pin receiving slots in each said side plate means;

each of said mounting-pin receiving slots having an open mouth portion at one end thereof and an apex portion at the other end thereof;

rotator means extending laterally between said apex portions of said first mounting-pin receiving slots in said laterally spaced, side plate means;

said rotator means mounted for rotational movement between at least a first and a second position;

the dimensional span between said apices of said first and second mounting-pin receiving slots being substantially equal to the dimensional span of the first and second mounting pins;

an arcuate locating recess in said mouth portions of said first mounting-pin receiving slots; and the dimensional span between said arcuate locating recesses and the mouths of said second mounting-pin receiving slots being greater than the dimensional span of the first and second mounting pins.

* * * * *